US010648464B2

(12) United States Patent
Fitzpatrick et al.

(10) Patent No.: US 10,648,464 B2
(45) Date of Patent: May 12, 2020

(54) PNEUMATIC PUMP

(71) Applicant: Faurecia Automotive Seating, LLC, Auburn Hills, MI (US)

(72) Inventors: Robert C. Fitzpatrick, Holland, MI (US); Todd Sieting, Clarkston, MI (US)

(73) Assignee: Faurecia Automotive Seating, LLC, Auburn Hills, MI (US)

( * ) Notice: Subject to any disclaimer, the term of this patent is extended or adjusted under 35 U.S.C. 154(b) by 237 days.

(21) Appl. No.: 15/629,283

(22) Filed: Jun. 21, 2017

(65) Prior Publication Data

US 2017/0370357 A1 Dec. 28, 2017

Related U.S. Application Data

(60) Provisional application No. 62/353,268, filed on Jun. 22, 2016.

(51) Int. Cl.

| | |
|---|---|
| ***F04B 45/02*** | (2006.01) |
| ***F04B 45/04*** | (2006.01) |
| ***F04B 53/00*** | (2006.01) |
| ***F04B 27/10*** | (2006.01) |

(52) U.S. Cl.
CPC ..... *F04B 45/043* (2013.01); *F04B 27/1063* (2013.01); *F04B 53/00* (2013.01)

(58) Field of Classification Search
CPC .. F04B 43/025; F04B 45/043; F04B 27/1063; F04B 1/148; F04B 45/02; F04B 45/047
See application file for complete search history.

(56) References Cited

U.S. PATENT DOCUMENTS

| | | | | |
|---|---|---|---|---|
| 3,514,221 | A * | 5/1970 | Hasquenoph | F04B 1/124 417/206 |
| 4,785,819 | A * | 11/1988 | Pearce | G10K 11/355 600/446 |
| 5,001,810 | A * | 3/1991 | Baer | E05D 3/122 16/302 |
| 5,588,811 | A * | 12/1996 | Price | A47C 20/048 417/350 |
| 6,048,179 | A * | 4/2000 | Forster | B60K 6/26 417/222.1 |
| 6,206,664 | B1 | 3/2001 | Kakizawa | |
| 6,382,928 | B1 * | 5/2002 | Chang | F04B 43/026 417/269 |
| 6,506,033 | B2 * | 1/2003 | Fukami | F04B 1/148 417/420 |
| 7,040,876 | B2 * | 5/2006 | Fukami | F04B 43/026 417/413.1 |

(Continued)

FOREIGN PATENT DOCUMENTS

| | | | | |
|---|---|---|---|---|
| JP | 2000352379 A | * 12/2000 | | F04B 43/02 |

OTHER PUBLICATIONS

Machine Translation of Japanese Patent JP 2000352379 A published on Dec. 19, 2003.*

*Primary Examiner* — Peter J Bertheaud
*Assistant Examiner* — Dnyanesh G Kasture
(74) *Attorney, Agent, or Firm* — Barnes & THornburg LLP

(57) ABSTRACT

A vehicle seat in accordance with the present disclosure includes a seat bottom, a seat back, and an occupant comfort system. The occupant comfort system includes a pneumatic pump and a pneumatic bladder. The pneumatic pump provides a stream of pressurized air to the pneumatic bladder to inflate the pneumatic bladder.

22 Claims, 13 Drawing Sheets

(56) References Cited

U.S. PATENT DOCUMENTS

| | | | | |
|---|---|---|---|---|
| 2002/0073839 | A1* | 6/2002 | Tagami | F04B 27/1072 92/73 |
| 2005/0047928 | A1* | 3/2005 | Koelzer | F04B 27/1009 417/269 |
| 2008/0106071 | A1* | 5/2008 | Huang | B60R 21/276 280/728.1 |
| 2014/0099222 | A1* | 4/2014 | Yu | F04B 43/026 417/437 |
| 2017/0184089 | A1* | 6/2017 | Reeves | F04B 1/053 |

* cited by examiner

PNEUMATIC PUMP

PRIORITY CLAIM

This application claims priority under 35 U.S.C. § 119(e) to U.S. Provisional Application Ser. No. 62/353,268, filed Jun. 22, 2016, which is expressly incorporated by reference herein.

BACKGROUND

The present disclosure relates to a pneumatic pump, and particularly to a pneumatic pump for use in a vehicle seat. More particularly the present disclosure relates a pneumatic pump that includes a motor.

SUMMARY

According to the present disclosure, a vehicle seat in accordance with the present disclosure includes a seat bottom and a seat back. At least one pneumatic bladder is provided in the vehicle seat. A pneumatic pump may be used to inflate the pneumatic bladder.

In illustrative embodiments, the pneumatic pump includes a fluid-driving system, a fluid regulator, and a pump housing. The fluid-driving system may be configured to receive an airflow from an environment outside of the pneumatic pump and pressurize and communicate the airflow to the pneumatic bladder. The fluid regulator may control the flow of air from the environment to the pneumatic bladder by restricting air flow under certain conditions. The pump housing may provide an internal space for the fluid-driving system and the fluid regulator.

In illustrative embodiments, the fluid driving system includes a motor, an actuator plate, and a plurality of vertically extending diaphragms. The motor may be configured to rotate about a central axis. The actuator plate may be angled relative to a horizontal axis that is perpendicular to the central axis. The actuator plate may be positioned so that one portion of the actuator plate compresses the plurality of diaphragms and another portion of the actuator plate expands the plurality of diaphragms as the motor rotates.

In illustrative embodiments, the fluid driving system may include a motor, a first actuator plate, a second actuator plate, and a plurality of radially extending diaphragms. The motor may be configured to rotate about a central axis. The first actuator plate may be coupled to the motor and positioned along a first axis spaced apart from the central axis. The second actuator plate may be coupled to the motor and positioned along a second axis spaced apart from the central axis and opposite the first axis. The first and second actuators may compress and expand a first diaphragm and an opposite, second diaphragm as the motor rotates about the central axis and moves the first and second actuator plates.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 5 is a front elevation view of the motor at an orientation of 0 degrees showing that the angled top surface of the motor positions the actuator plate such that a first diaphragm and a second diaphragm are being compressed and a forth diaphragm and a fifth diaphragm are being expanded;

FIG. 6 is view similar to FIG. 5 of the motor rotated to an orientation of 90 degrees and showing that the motor positions the actuator plate such that a third diaphragm is compressed and a sixth diaphragm is expanded;

FIG. 7 is view similar to FIG. 6 of the motor rotated to an orientation of 180 degrees and showing that the motor positions the actuator plate such that the forth diaphragm and the fifth diaphragm are being compressed and the first diaphragm and the second diaphragm are being expanded;

FIG. 8 is view similar to FIG. 7 of the motor rotated to an orientation of 270 degrees and showing that the motor positions the actuator plate such that the sixth diaphragm is compressed and the third diaphragm is expanded;

FIG. 17 is a front elevation view of the motor at an orientation of 0 degrees showing that the ball bearing unit positions the actuator plate such that a first diaphragm is fully compressed, second, third, and fourth diaphragms are partly compressed, and a fifth diaphragm is fully expanded;

FIG. 18 is a front elevation view of the ball bearing unit rotated to an orientation of 90 degrees showing that the ball bearing unit positions the actuator plate such that the third diaphragm is fully compressed and the first, second, fourth and fifth diaphragms are partially expanded;

FIG. 19 is a front elevation view of the ball bearing unit rotated to an orientation of 180 degrees showing that the ball bearing unit positions the actuator plate such that the fifth diaphragm if fully compressed, the second, third, and fourth diaphragms are partially compressed, and the first diaphragm is fully expanded;

FIG. 20 is a front elevation view of the ball bearing unit rotated to an orientation of 270 degrees showing that the motor positions the actuator plate such that the third diaphragm is fully expanded and the first, second, fourth, and fifth diaphragms are partially compressed;

FIG. 28 is a top plan view of the motor at an orientation of 0 degrees;

FIG. 29 is view similar to FIG. 28 of the motor rotated to an orientation of 60;

FIG. 30 is a view similar to FIG. 29 of the motor rotated to an orientation of 120 degrees;

FIG. 31 is a view similar to FIG. 30 of the motor rotated to an orientation of 180 degrees;

Figure 25:
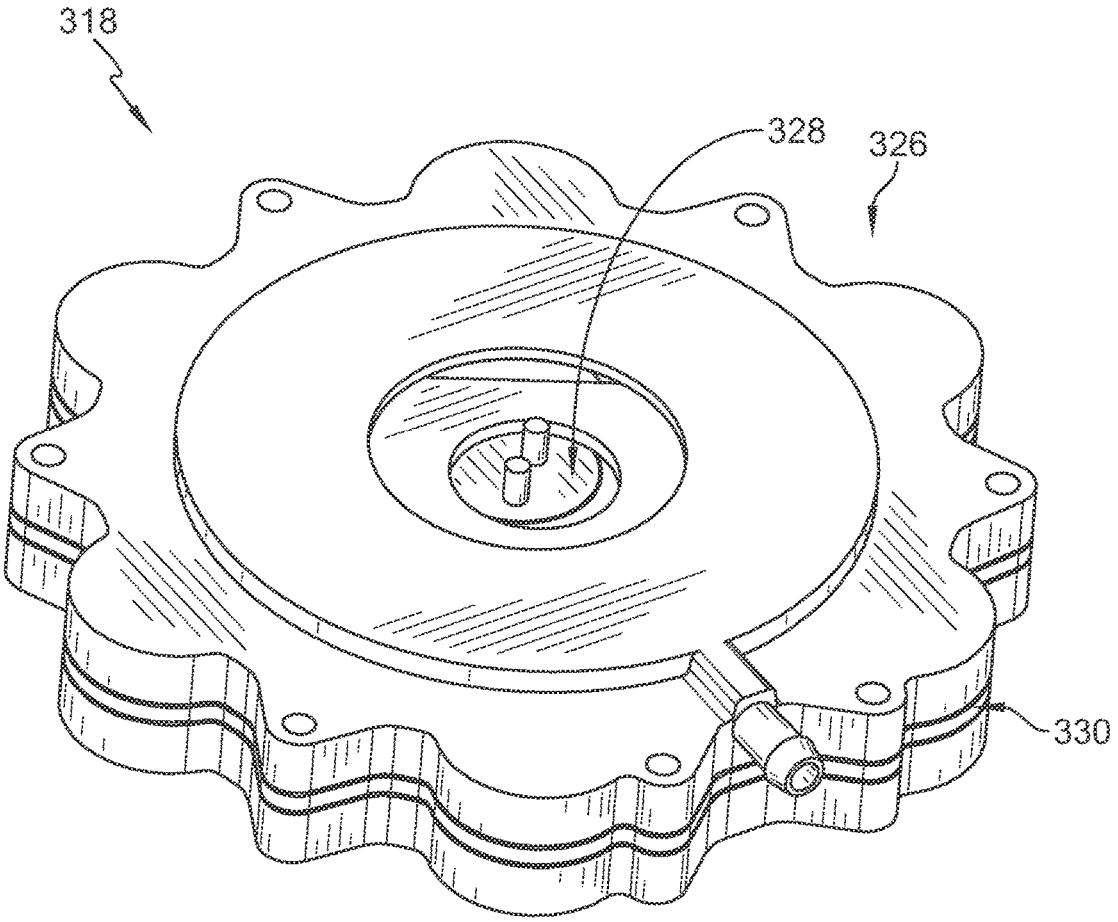
FIG. 25 is an perspective view of a third embodiment of a pneumatic pump in accordance with the present disclosure.
Figure 32:
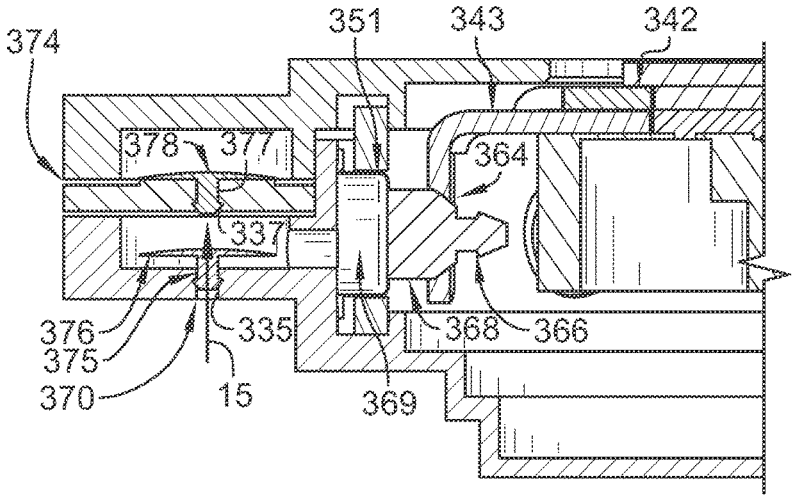
FIG. 32 is an enlarged section of a portion of the third embodiment of the pneumatic pump showing that an airflow opens one of the inlet valves and flows through the inlet ring and into the diaphragm as the diaphragm expands.
Figure 33:
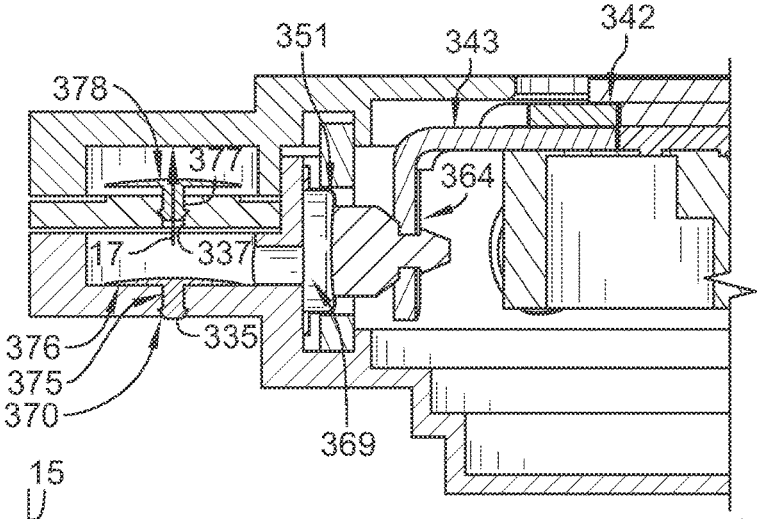
Figure 34:
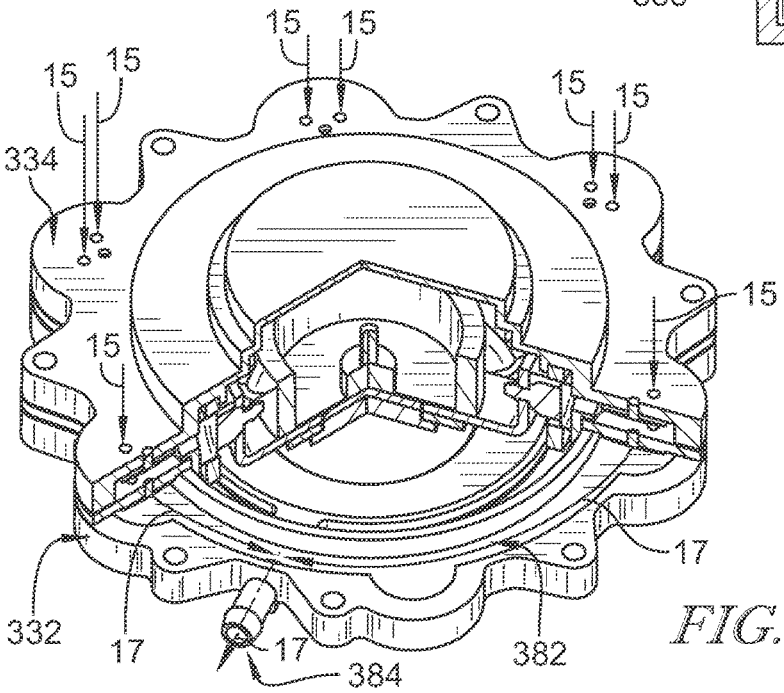

FIG. 33 is a view similar to FIG. 32 showing that a pressurized airflow closes the inlet valve and flows out of the diaphragm through the outlet ring as the diaphragm compresses; and FIG. 34 is a partial perspective view of the pneumatic pump of FIG. 25 with portions of the pneumatic pump hidden to show that the pneumatic pump is configured to inject multiple pressurized airflows through a plurality of outlet passageways.

DETAILED DESCRIPTION

A first embodiment of a pneumatic pump 18 in accordance with the present disclosure is shown in FIGS. 1-12. The pneumatic pump 18 is configured to provide compressed streams of air to one or more pneumatic bladders included in an occupant comfort system while minimizing packaging space and noise emission. A second embodiment of a pneumatic pump 218 in accordance with the present disclosure is shown in FIGS. 13-24. A third embodiment of a pneumatic pump 318 in accordance with the present disclosure is shown in FIGS. 25-34.

Figure 1:
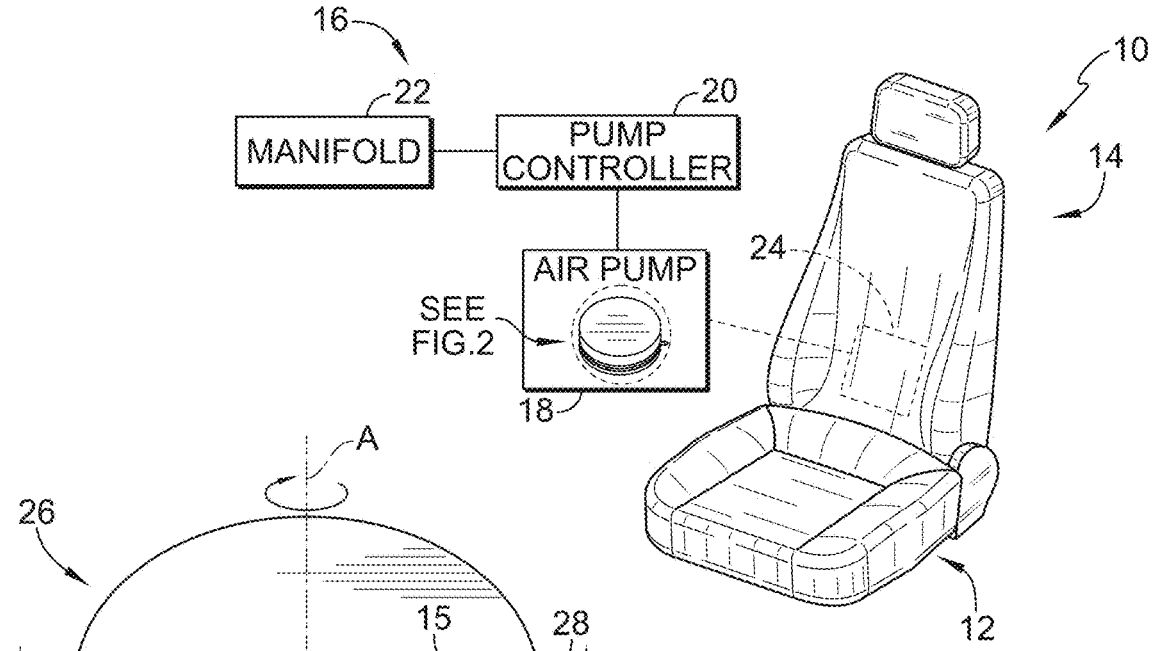
FIG. 1 is a perspective and diagrammatic view of a vehicle seat in accordance with the present disclosure suggesting that a pneumatic pump and a pump controller cooperating together to inflate an air bladder included in the vehicle seat.

A vehicle seat 10, in accordance with the present disclosure, includes a seat bottom 12, a seat back 14, and an occupant comfort system 16 as shown in FIG. 1. The seat bottom 12 is coupled to a vehicle floor for selective movement back and forth relative to the vehicle floor. The seat back 14 is coupled to the seat bottom 12 to move relative to the sea bottom. The occupant comfort system 16 includes one or more pneumatic bladders 24 which are supplied pressurized air by a pneumatic pump 18 to maximize comfort of an occupant resting on the vehicle seat 10 as suggested in FIG. 1. The pneumatic pump 18 provides pressurized air selectively to the pneumatic bladders 24 with low noise, small size, and efficient operation.

Figure 2:
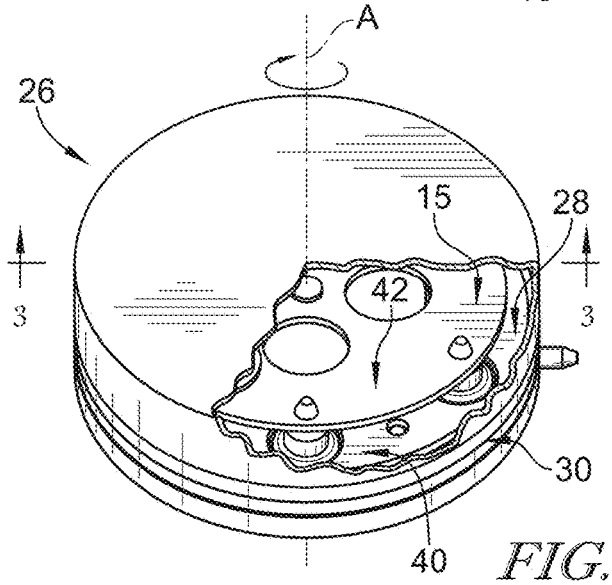
FIG. 2 is an enlarged perspective view of the pneumatic pump from FIG. 1 with a portion broken away to reveal that the pneumatic pump includes a motor, an actuator plate, and a plurality of diaphragms coupled to the actuator plate that are configured to compress and expand as the motor rotates about a central axis and moves the actuator plate.
Figure 3:
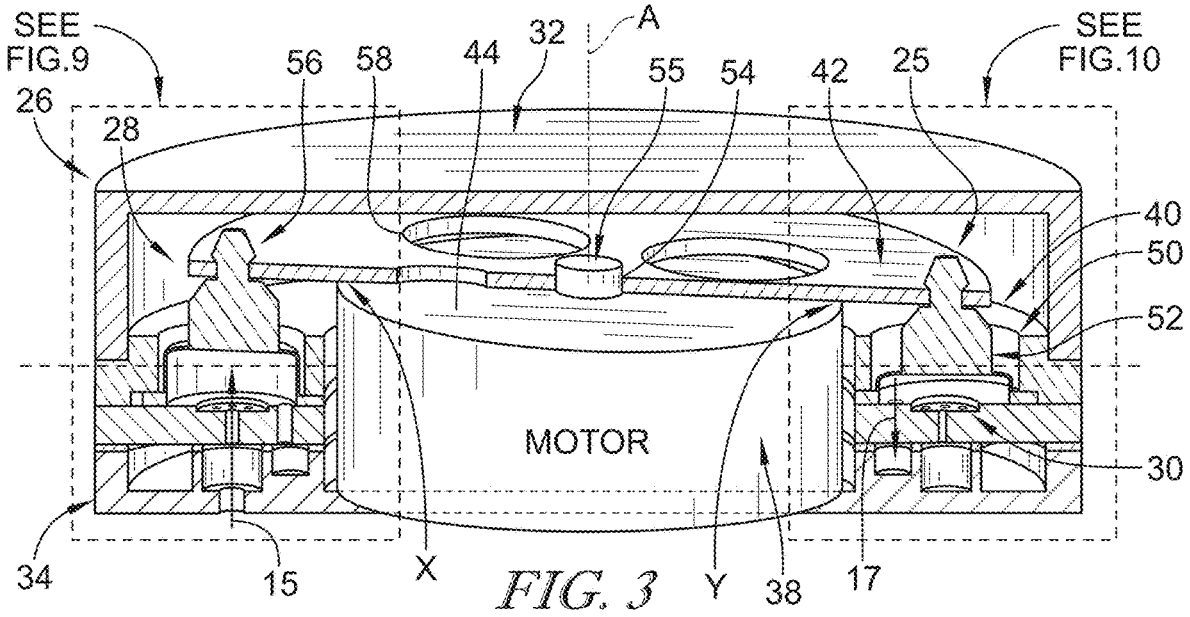
FIG. 3 is a sectional view taken along line 3-3 of FIG. 2 showing that the motor includes an angled top surface and the actuator plate is arranged on the angled top surface to compress a diaphragm and expand another diaphragm positioned opposite the first diaphragm as the motor rotates.

A first embodiment of pneumatic pump 18 in accordance with the present disclosure is shown in FIGS. 2-12. The pneumatic pump 18 includes a pump housing 26, a fluid-driving system 28, and a fluid regulator 30 as shown in FIG. 2. The pump housing 26 is formed to include an internal space 25 therein. The fluid regulator 30 and the fluid-driving system 28 are located in the pump housing 26 as shown in FIG. 3. The fluid-driving system 28 moves within the pump housing 26 to draw an airflow 15 from the environment and inject a pressurized airflow 17 into the at least one pneumatic bladder 24. The fluid regulator 30 is configured to open and receive the airflow 15 from an environment outside of the pump housing 26 and then communicate the pressurized airflow 17 into the at least one pneumatic bladder 24 as shown in FIG. 3.

Figure 4:
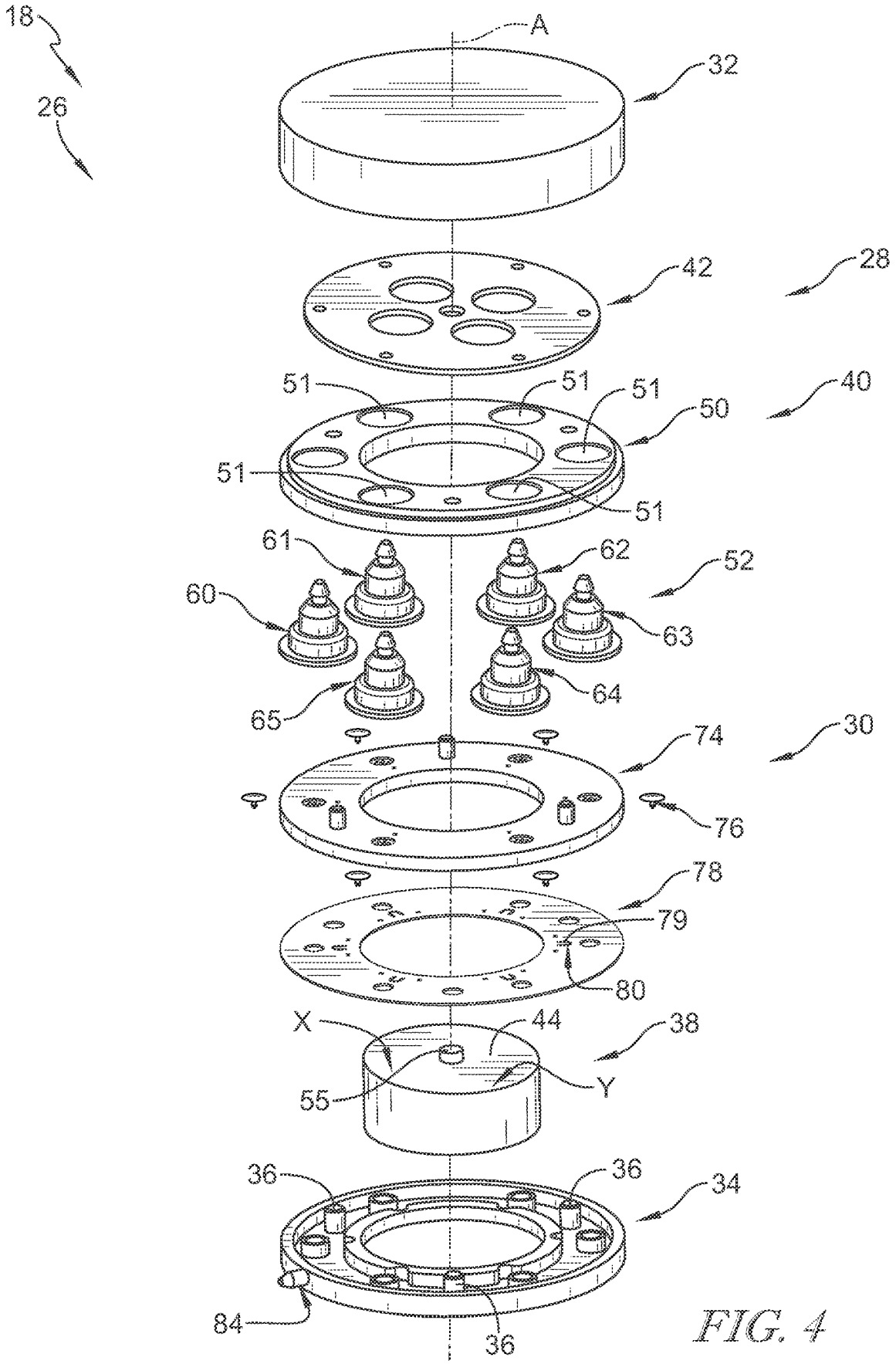
FIG. 4 is an exploded assembly view of the pneumatic pump of FIGS. 1-3 showing that the pneumatic pump includes, from top to bottom, a top casing, the actuator plate, a diaphragm ring, six diaphragms, six inlet valves, an inlet ring, an outlet ring, a motor, and a bottom casing.

The fluid-driving system 28 includes a hollow cylindrical actuator having an angled top surface, a motor 38 coupled to the actuator, a diaphragm system 40 and an actuator plate 42 as shown in FIGS. 3 and 4. The motor 38 is configured to rotate about a central axis A. The diaphragm system 40 is spaced apart radially and arranged to surround the motor 38 in the internal space 25 and is coupled to the actuator plate 42. The actuator plate 42 is driven by the motor 38 to cause the diaphragm system 40 to draw in air and pressurize the air.

The diaphragm system 40 includes a diaphragm ring 50 and a plurality of diaphragms 52 as shown in FIGS. 3 and 4. The diaphragm ring 50 is arranged to extend around and surround the motor 38. The diaphragm ring 50 is configured to support and position the plurality of diaphragms 52 so that the plurality of diaphragms 52 remains in fluid communication with the fluid regulator 30. The plurality of diaphragms 52 is coupled to the fluid-driving system 28. The plurality of diaphragms 52 are arranged to extend downwardly toward the fluid regulator 30.

Each diaphragm of the plurality of diaphragms 52 is configured to move between an expanded configuration in which air is drawn into the diaphragm through the fluid regulator 30 and a compressed configuration in which pressurized air is expelled from the diaphragm into the fluid regulator 30. Each diaphragm 52 expands and contracts in series as the motor 38 rotates driving the fluid-driving system 28. In one example, each diaphragm expands into the expanded arrangement and contracts into the contracted arrangement once during one rotation of the motor 38.

The fluid-driving system 28 is configured to provide a reciprocating up-and-down motion that moves the diaphragm system 40 and the actuator plate 42. The actuator includes an angled top surface 44 that rotates about the central axis A. As the angled top surface 44 rotates, the angled top surface 44 engages the actuator plate 42 to cause the actuator plate 42 to move to cause each diaphragm in the plurality of diaphragms 52 to expand and contract in series as shown in FIGS. 5-8.

The actuator plate 42 is formed to include a motor aperture 54, a series of diaphragm mounts 56, and friction reducing apertures 58. The motor aperture 54 is configured to receive an actuator plate guide 55 coupled to the motor 38 to retain the actuator plate 42 in a central location relative to the motor 38 and the central axis A. The diaphragm mounts 56 are configured to couple the plurality of diaphragms 52 to the actuator plate 42. The friction reducing apertures 58 are spaced circumferentially around the motor aperture 54 and are configured to minimize an amount of surface area contract between the actuator plate 42 and the angled top surface 44 as the motor 38 rotates beneath the actuator plate 42 so that friction is minimized.

The angled top surface 44 of the motor 38 includes an upper portion X and a lower portion Y. The central axis A is located between the upper portion X and the lower portion Y. The upper portion X is arranged to extend upwardly from the central axis A toward a top casing 32 of the pump housing 26. The lower portion Y is arranged to extend downwardly from the central axis A toward the diaphragm ring 50.

The plurality of diaphragms 52 includes a first diaphragm 60, a second diaphragm 61, a third diaphragm 62, a fourth diaphragm 63, a fifth diaphragm 64, and a sixth diaphragm 65 as shown in FIG. 4. Each diaphragm 60, 61, 62, 63, 64, 65 is equally spaced circumferentially around the actuator plate 42. The angled top surface 44 engages actuator plate 42 and moves actuator plate 42 and each diaphragm 60, 61, 62, 63, 64, 65 from the expanded configuration to the compressed configuration. The expanded configuration occurs when the upper portion X of the angled top surface 44 is aligned circumferentially with one of the diaphragms 60, 61, 62, 63, 64, 65. The compressed configuration occurs when the lower portion Y of the angled top surface 44 is aligned circumferentially with one of the diaphragms 60, 61, 62, 63, 64, 65. In one example, this motion occurs during one rotation of motor 38 as shown in FIGS. 5-8.

Figure 5:
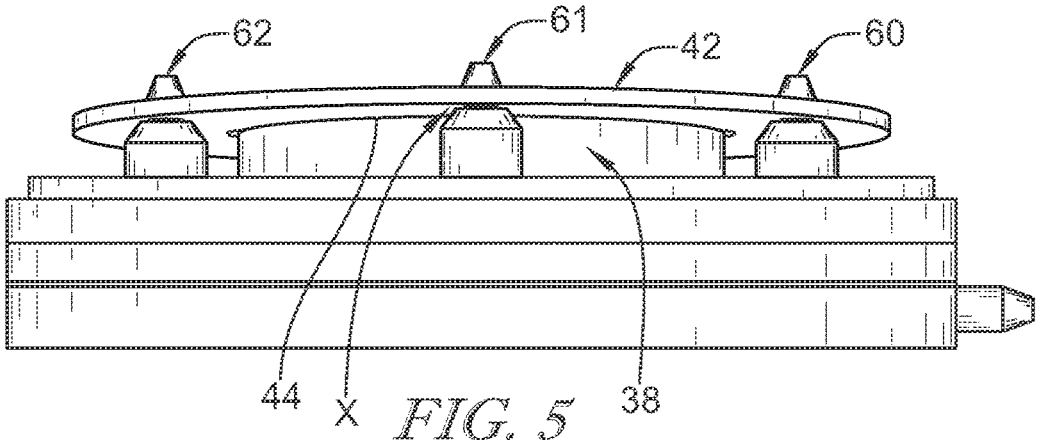
FIGS. 5-8 are a series of views showing the motor rotating 360 degrees about a central axis and moving the actuator plate within the pump housing to compress and expand the plurality of diaphragms.

In one example, the motor begins at 0 degrees of rotation as shown in FIG. 5. The upper portion X of angled top surface 44 is aligned circumferentially with the second diaphragm 61. Although not shown in FIG. 5, the lower portion Y is aligned circumferentially with the fifth diaphragm 64. The upper portion X positions the actuator plate 42 so that the second diaphragm 61 is fully expanded in the expanded configuration. The lower portion Y positions the actuator plate 42 so that the fifth diaphragm 64 is fully compressed in the compressed configuration. In this arrangement, the first and sixth diaphragms 60, 65 are moving toward the compressed configuration as the motor 38 rotates clockwise about the central axis A. The third and fourth diaphragms 62, 63 are moving toward the expanded configuration as the motor 38 rotates clockwise about central axis A.

Figure 6:
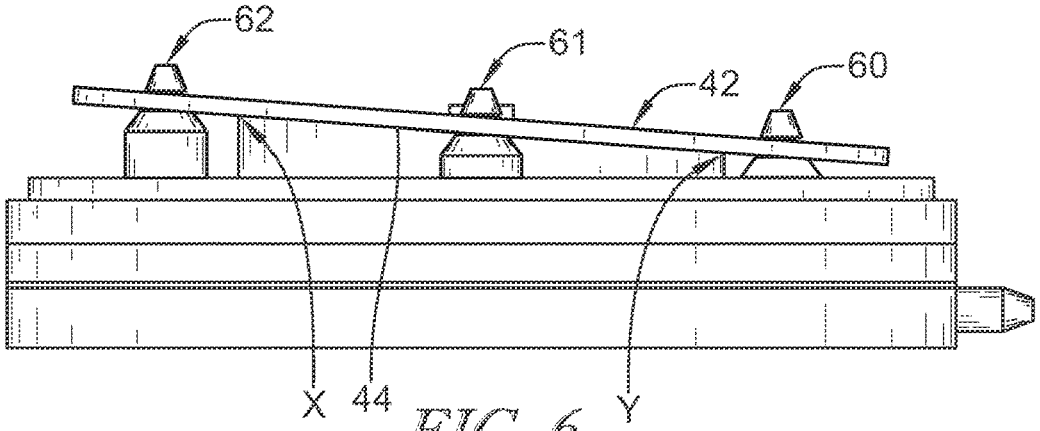

In the example described above, the motor rotates 90 degrees clockwise about the central axis A as shown in FIG. 6 so that the motor 38 is rotated 90 degrees from the orientation shown in FIG. 5. The upper portion X is arranged circumferentially between the third and fourth diaphragms 62, 63 and the lower portion Y is arranged circumferentially between the first and sixth diaphragms 60, 65. In this arrangement, the upper portion X and the lower portion Y position the actuator plate 42 so that the first, second, and third diaphragms 60, 61, and 62 are moving toward the compressed configuration as the motor 38 rotates clockwise about central axis A. The upper portion X and the lower portion Y position the actuator plate 42 so that the fourth, fifth, and sixth diaphragms 63, 64, 65 are moving toward the expanded configuration as the motor 38 rotates clockwise about central axis A.

Figure 7:
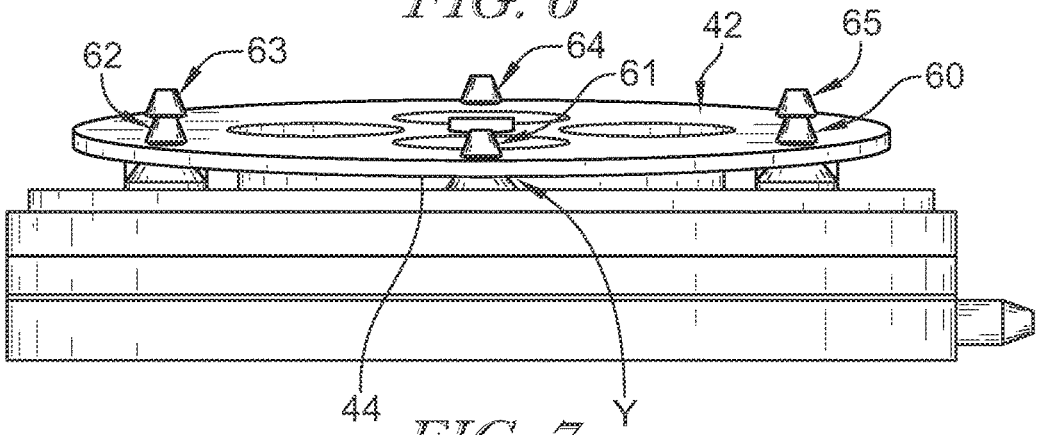

As shown in FIG. 7, the motor rotates another 90 degrees clockwise along the central axis A so that the motor 38 is rotated 180 degrees from the orientation shown in FIG. 5. The upper portion X is aligned circumferentially with the fifth diaphragm 64 and the lower portion Y is aligned circumferentially with the second diaphragm 61. The upper portion X positions the actuator plate 42 so that the fifth diaphragm 64 is fully expanded in the expanded configuration. The lower portion Y positions the actuator plate 42 so that the second diaphragm 61 is fully compressed in the compressed configuration. The third and fourth diaphragms 62, 63 are moving toward the compressed configuration as the motor 38 rotates clockwise about the central axis A. The first and sixth diaphragms 60, 64 are moving toward the expanded configuration as the motor 38 rotates clockwise about central axis A.

Figure 8:
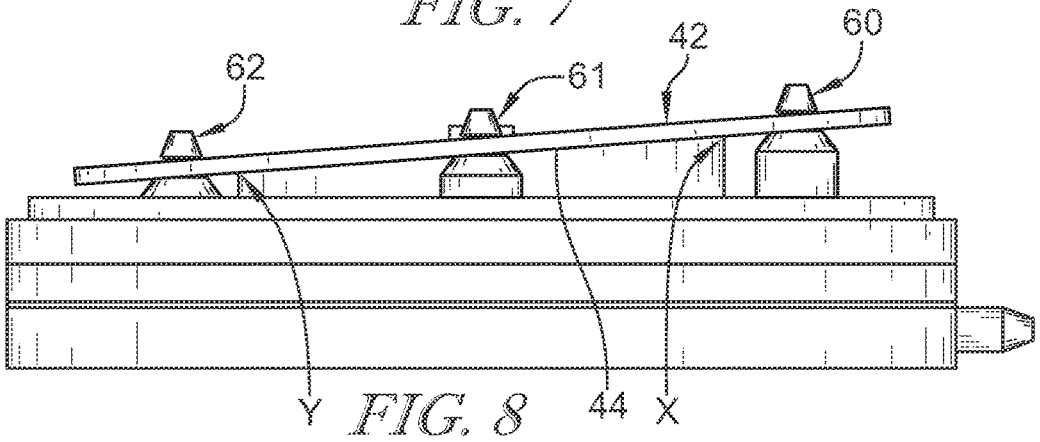

As shown in FIG. 8, the motor rotates another 90 degrees clockwise along the central axis A so that the motor 38 is rotated 270 degrees from the orientation shown in FIG. 5. The upper portion X is arranged circumferentially between the first and sixth diaphragms 60, 64 and the lower portion Y is arranged circumferentially between the third and fourth diaphragms 61, 62. The upper portion X and the lower portion Y position the actuator plate 42 so that the first, second, and third diaphragms 60, 61, and 62 are moving toward the expanded configuration as the motor 38 rotates clockwise about central axis A. The upper portion X and the lower portion Y position the actuator plate 42 so that the fourth, fifth, and sixth diaphragms 63, 64, and 65 are moving toward the compressed configuration as the motor 38 rotates clockwise about central axis A.

The motor 38 is configured to continue rotating another 90 degrees clockwise along the central axis A so that the motor 38 completes one full rotation of 360 degrees. At a rotation of 360 degrees, the motor 38 positions the actuator plate 42 at the same orientation described above regarding FIG. 5.

Figure 9:
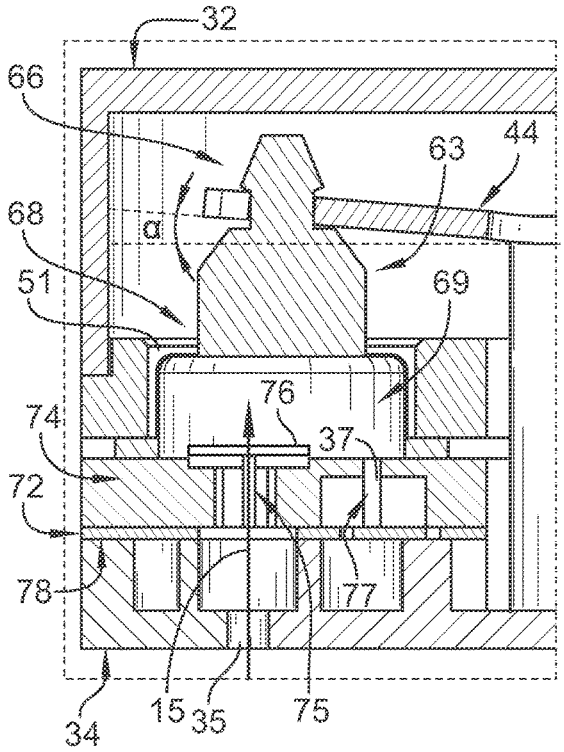
FIG. 9 is an enlarged portion of FIG. 3 showing that as the diaphragm expands, an airflow is pulled upwardly into the diaphragm through one of the inlet valves in the inlet ring.

The angled top surface 44 is configured to angle the actuator plate 42 at an angle $\alpha$ of about 6 degrees from a horizontal axis B as shown in FIG. 9. The horizontal axis B is generally perpendicular to the central axis A. The upper portion X of the angled top surface 44 angles a first half, or portion, of actuator plate 42 upward relative to the central axis A at the angle $\alpha$ of about six degrees from horizontal axis B. The lower portion Y of angled top surface 44 angles a second half, or portion, of actuator plate 42 downward relative to the central axis A at the angle $\alpha$ of about six degrees from the horizontal axis B. While the angle $\alpha$ is illustratively about six degrees, any suitable angle may be used.

Figure 10:
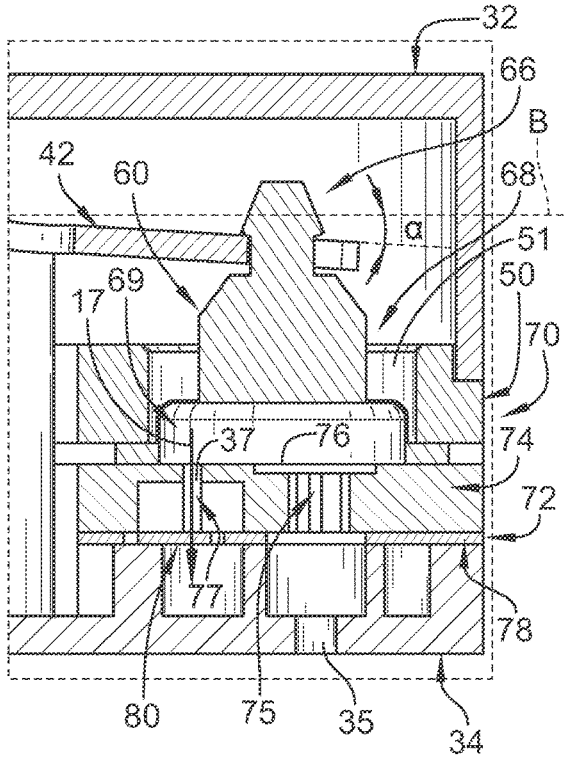
FIG. 10 is an enlarged portion of FIG. 3 showing that as the diaphragm compresses, a pressurized airflow closes the inlet valve and flows out of the diaphragm through the outlet ring.

Each diaphragm 60, 61, 62, 63, 64, 65 includes a diaphragm mount 66 and diaphragm housing 68 as shown in FIGS. 9 and 10. Each diaphragm mount 66 is coupled to the actuator plate 42. Each diaphragm housing 68 is coupled to a complementary diaphragm mount 66 and is arranged to extend through diaphragm tubes 51 formed in the diaphragm ring 50. Each diaphragm housing 68 is formed to include a compression chamber 69 that opens toward the fluid regulator 30.

As shown in FIG. 9, the fourth diaphragm 63 is positioned in the expanded configuration by the actuator plate 42. The compression chamber 69 has a maximum volume in the expanded configuration. As compression chamber is expanded by actuator plate 42, airflow 15 is suctioned from outside pneumatic pump 18, through an inlet aperture 35, and into compression chamber 69.

As shown in FIG. 10, the first diaphragm 60 is positioned in the compressed configuration by the actuator plate 42. The compression chamber 69 has a minimum volume in the compressed configuration. As the compression chamber 69 is compressed by actuator plate 42, the airflow is pressurized and forced out of the compression chamber 69 through an outlet aperture 37.

The fluid regulator 30 includes a fluid inlet controller 70 and a fluid outlet controller 72 as shown in FIGS. 9 and 10. The fluid inlet controller 70 and the fluid outlet controller respond to the expansion and contraction of the plurality of diaphragms 52 to control airflow into and out of the compression chambers 69.

The fluid inlet controller 70 includes an inlet ring 74 and inlet valves 76 as shown in FIGS. 4 and 9. The inlet ring 74 is formed to include inlet passageways 75 extending from the inlet apertures 35 to the compression chambers 69. The inlet valves 76 extend through the inlet passageways 75. One inlet valve 76 is configured to open as the fourth diaphragm 63 expands into the expanded configuration as shown in FIG. 9. The inlet valve 76 is configured to close and restrict flow through the inlet passageway 75 as the first diaphragm 60 is compressed into the compressed configuration as shown in FIG. 10.

The fluid outlet controller 72 includes an outlet valve gasket 78 as shown in FIGS. 4 and 9. The outlet valve gasket 78 is arranged to control flow into and out of outlet passageways 77 formed in the inlet ring 74. The outlet valve gasket 78 is formed to include a plurality of U-shaped apertures 79 spaced apart circumferentially. The U-shaped apertures 79 define outlet flaps 80 that are arranged to cover outlet passageways 77. One outlet flap 80 is configured close and restrict flow through the outlet passageway 77 as the fourth diaphragm 63 is expanded into the expanded configuration as shown in FIG. 9. The outlet flap 80 is configured to open and allow flow though the outlet passageway 77 as the first diaphragm 60 is compressed into the compressed configuration as shown in FIG. 10.

The pump housing 26 includes a top casing 32 and the bottom casing 34 as shown in FIGS. 3 and 4. The top casing 32 is positioned above the fluid-driving system 28 and forms an upper boundary for internal space 25. The bottom casing 34 is positioned below the fluid regulator 30 and is formed to include a plurality of inlet apertures 35 spaced apart circumferentially around the bottom casing 34.

Figure 11:
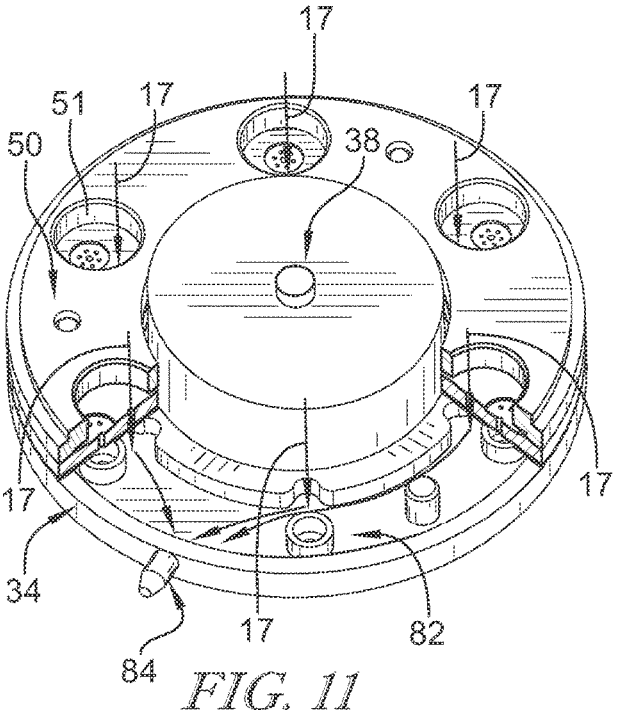
FIG. 11 is a partial perspective view of the pneumatic pump of FIG. 2 with portions of the pneumatic pump hidden to show that the pneumatic pump is configured to inject multiple pressurized airflows through a plurality of outlet passageways.
Figure 12:
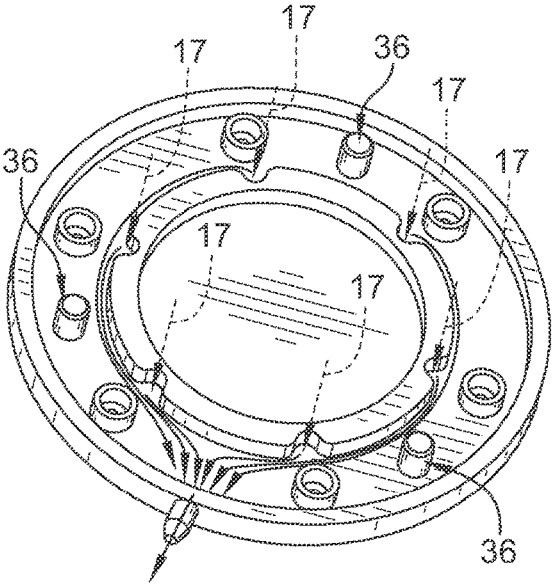
FIG. 12 is a partial perspective view of the pneumatic pump from FIG. 11 with the valve ring and the outlet ring hidden to show that each pressurized airflow flows through an outlet conduit formed in the bottom casing and out of the pneumatic pump through an outlet extending from the bottom casing.

The bottom casing 34 is shaped to define an outlet conduit 82 as shown in FIG. 11. The pressurized airflows 17 are forced into the outlet conduit 82 through the plurality of outlet apertures 37 as each diaphragm is compressed in series into the compressed configuration. The pressurized airflows 17 are injected out of the pneumatic pump 18 and into the pneumatic air bladders 24 through an outlet tube 84 coupled to the bottom casing 34 as shown in FIG. 12.

A plurality of posts 36 extend from bottom casing 34 toward the top casing 32 as shown in FIG. 4. The plurality of posts 36 aligns the fluid-driving system 28 and the fluid regulator 30 within the internal space 25. Fasteners (not shown) may extend through the top casing 32 and into the posts 36 to couple the top casing 32 and the bottom casing 34 and house the fluid-driving system 28 and the fluid regulator 30 in the internal space 25.

In one embodiment, the actuator plate 42 is made of an acetal homopolymer resin, such as, for example, a Dupont™ DELRIN® acetal resin to minimize friction between actuator plate 42 and motor 38. In another example, a layer of DELRIN® acetal resin may be coupled to the motor to provide the angled top surface 44. In another example, any suitable material may be used to minimize friction between the actuator plate 42 and the motor 38.

In one embodiment, a biasing spring (not shown) is used to bias the actuator plate 42 downward against the angled top surface 44 of the motor 38. In other embodiments, a retainer (not shown) may be coupled to the actuator plate guide 55 to retain the actuator plate 42 against the angled top surface 44 of the motor 38.

Figure 13:
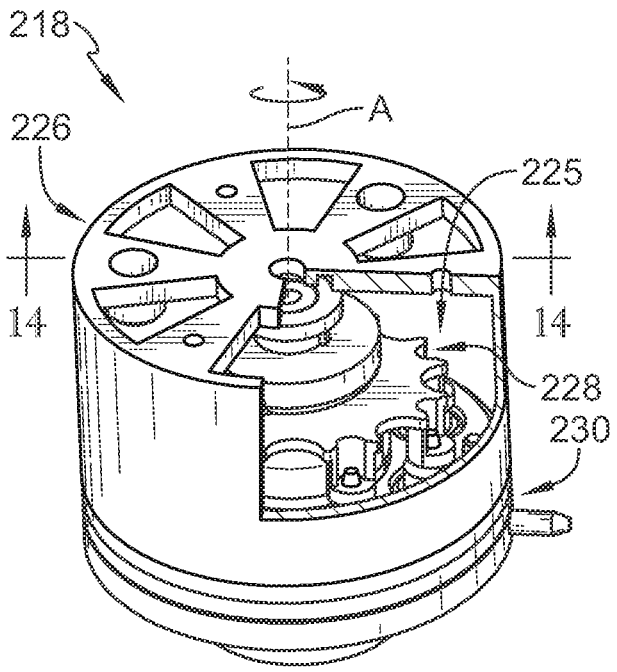
FIG. 13 is an enlarged perspective view of a second embodiment of a pneumatic pump with a portion broken away to reveal that the pneumatic pump includes a motor, a ball bearing unit, an actuator plate, and a plurality of diaphragms coupled to the actuator plate and configured to compress and expand as the motor rotates the ball bearing unit about a central axis and moves the actuator plate.
Figure 14:
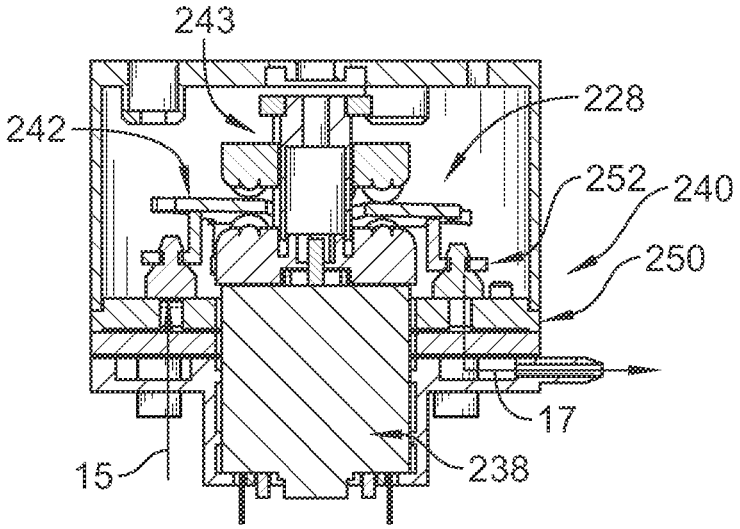
FIG. 14 is a sectional view taken along line 14-14 of FIG. 13 showing that the bearing driver includes a plurality of ball bearings that cooperate to angle the actuator plate so that the actuator plate compresses a first diaphragm and expands another diaphragm positioned opposite the first diaphragm as the motor rotates.

A second embodiment of a pneumatic pump 218 in accordance with the present disclosure is shown in FIGS. 13-24. The pneumatic pump 218 includes a pump housing 226, a fluid-driving system 228, and a fluid regulator 230 as shown in FIG. 13. Pump housing 226 is formed to include an internal space 225 therein. The fluid regulator 230 and the fluid-driving system 228 are located in the pump housing 226 as shown in FIG. 14. The fluid-driving system 228 moves within the pump housing 226 to draw an airflow 15 from an environment outside pneumatic pump 18 and inject a pressurized airflow 17 into the at least one pneumatic bladder 24. The fluid regulator 230 is configured to open and receive the airflow 15 from an environment outside of the pump housing 26 and then communicate the pressurized airflow 17 into the at least one pneumatic bladder 24 as shown in FIG. 3.

The fluid-driving system 228 includes a motor 238, a diaphragm system 240, an actuator plate 242, and a bearing driver 243 as shown in FIGS. 3 and 4. The motor 238 is configured to rotate about a central axis A. The diaphragm system 240 is spaced apart radially and arranged to surround the motor 238 in the internal space 225 and is coupled to the actuator plate 242. The actuator plate 242 is driven by the bearing driver 243 to cause the diaphragm system 40 to draw in air and pressurize the air. The bearing driver 243 is coupled to the motor 238 and is configured to rotate about the central axis A with the motor 238.

The diaphragm system 240 includes a diaphragm ring 250 and a plurality of diaphragms 252 as shown in FIGS. 3 and 4. The diaphragm ring 250 is arranged to extend around and surround motor 238. The diaphragm ring 250 is configured to support and position the plurality of diaphragms 252 so that the plurality of diaphragms 252 remains in fluid communication with the fluid regulator 230. The plurality of diaphragms 252 is coupled to the actuator plate 242. The plurality of diaphragms 52 are arranged to extend downwardly toward the fluid regulator 230.

Each diaphragm of the plurality of diaphragms 252 is configured to move between an expanded configuration in which air is drawn into the diaphragm through the fluid regulator 30 and a compressed configuration in which pressurized air is expelled from the diaphragm into the fluid regulator 230. Each diaphragm 252 expands and contracts in series as the motor 238 rotates the bearing driver 243. In one example, each diaphragm expands into the expanded configuration and contracts into the contracted configuration once during one rotation of the motor 238.

Figure 16:
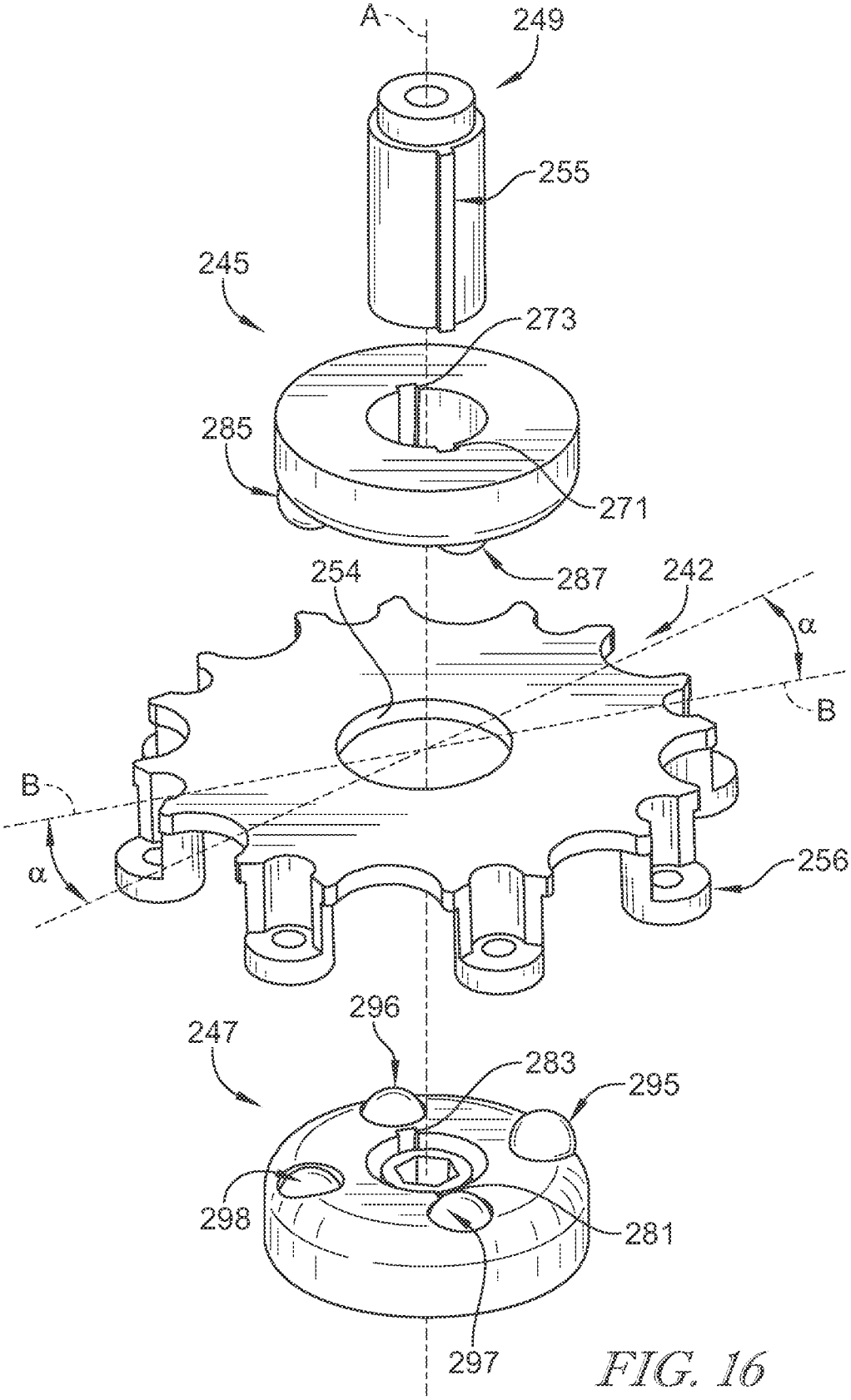
FIG. 16 is an exploded assembly view of the ball bearing unit and the actuator plate showing that the ball bearing unit includes, from top to bottom, the ball bearing unit shaft, the upper ball bearing mount above the actuator plate, the lower ball bearing mount below the actuator plate, and a plurality of ball bearings coupled to each of the upper and lower ball bearing mounts.

The fluid-driving system 228 is configured to provide a reciprocating up-and-down motion that moves the diaphragm system 240 and the actuator plate 242. The bearing driver 243 includes an upper bearing mount 245, a lower bearing mount 247, a bearing shaft 249, and a plurality of ball bearings 253 that rotate about the central axis A as shown in FIG. 16. As the bearing driver 243 rotates, the plurality of ball bearings 253 engages the actuator plate 242 to cause the actuator plate to move. The plurality of ball bearings 253 is arranged on varied planes that cooperate to angle the actuator plate 242 relative to a horizontal axis B that is perpendicular to central axis A as shown in FIGS. 16-20. The angled actuator plate 242 is moved by bearing driver 243 to cause each diaphragm in the plurality of diaphragms 252 to expand and contract in series as shown in FIGS. 17-20.

Figure 15:
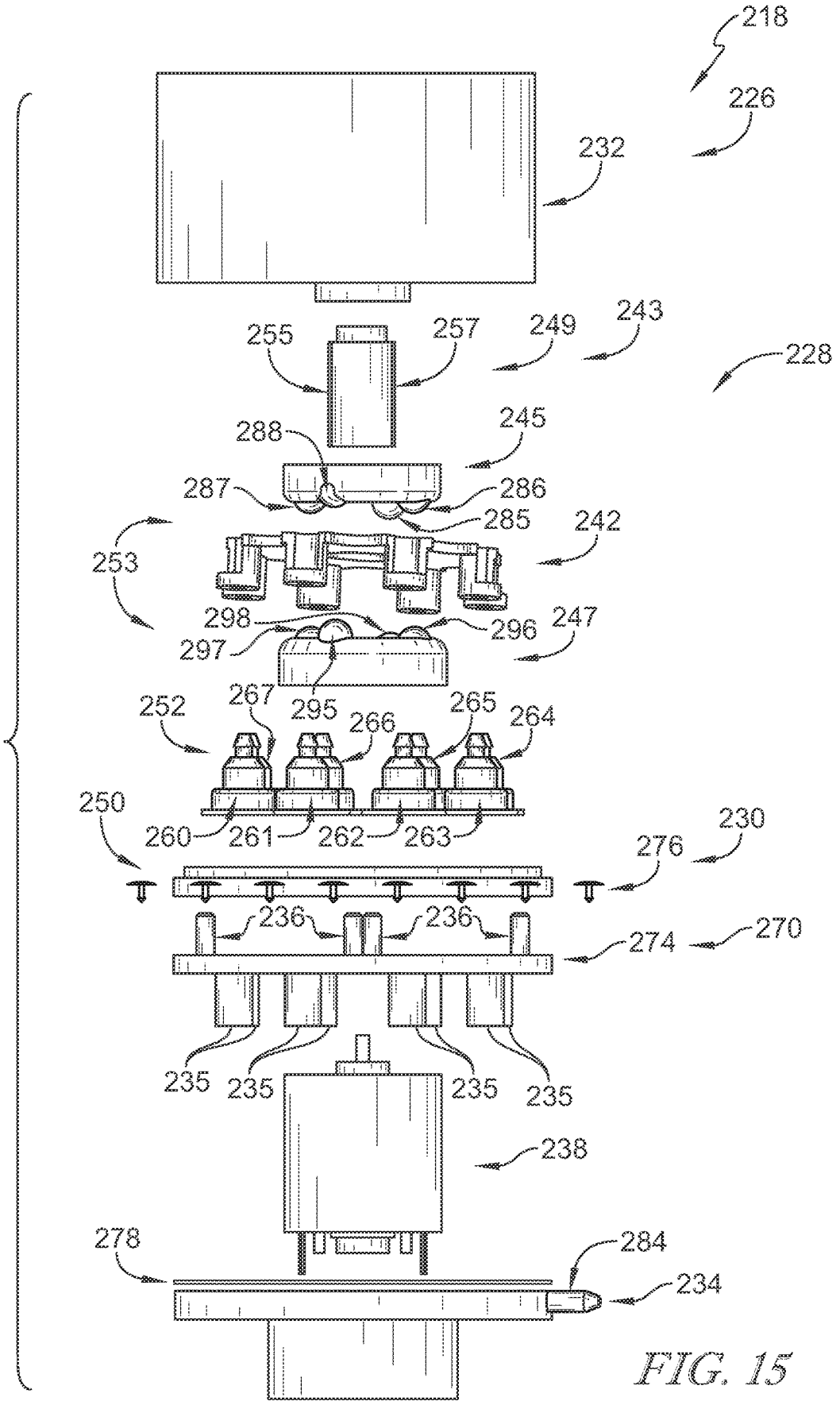
FIG. 15 is an exploded assembly view of the pneumatic pump of FIGS. 13 and 14 showing that the pneumatic pump includes, from top to bottom, a top casing, a ball bearing unit shaft, an upper ball bearing mount, the actuator plate, a lower ball bearing mount, eight diaphragms, eight inlet valves, an inlet ring, an outlet ring, a motor, and a bottom casing.

As shown in FIG. 16, the bearing driver 243 is arranged so that the upper bearing mount 245 and the lower bearing mount 247 rotate about central axis A at the same time. To accomplish this, the bearing shaft 249 includes a first rib 255 and a second rib 257 that extend from the upper bearing mount 245 to the lower bearing mount 247 as shown in FIGS. 15 and 16. The ribs 255, 257 are configured to extend into slots 271, 273 formed in the upper bearing mount 245 and into slots 281, 283 formed in the lower bearing mount 247. The lower bearing mount is then coupled to the motor 238 so that the upper bearing mount and the lower bearing mount rotate about the central axis A at the same time.

The actuator plate 242 is formed to include a shaft aperture 254 and a series of diaphragm mounts 256. The shaft aperture 254 is configured to receive the bearing shaft 249 to retain actuator plate 242 in a central location relative to the motor 238 and the central axis A. The diaphragm mounts 256 are configured to couple the plurality of diaphragms 252 to the actuator plate 242.

The upper bearing mount 245 of the bearing driver 243 includes a first ball 285, a second ball 286, a third ball 287, and a forth ball 288 as shown in FIG. 15. The lower bearing mount 247 of the bearing driver 243 also includes a first ball 295, a second ball 296, a third ball 297, and a forth ball 298.

Figure 17:
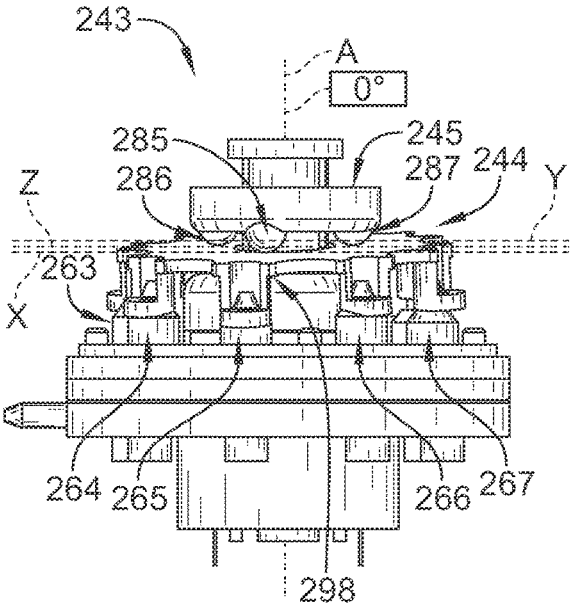
FIGS. 17-20 are a series of views showing the ball bearing unit rotating 360 degrees about a central axis and moving the actuator plate within the pump housing to compress and expand the plurality of diaphragms.
Figure 18:
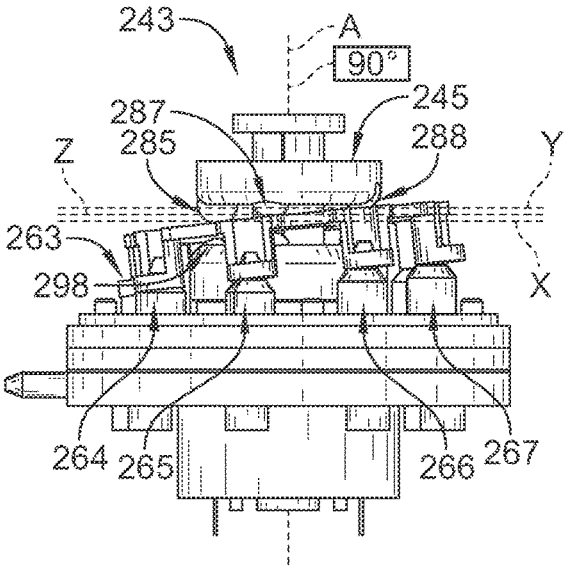

The first ball 285 of upper bearing mount 245 engages the actuator plate 242 on a first axis X as shown in FIGS. 17-20. The fourth ball 288 of the upper bearing mount 245 engages the actuator plate 242 on a second axis Y. The second ball 286 and the third ball 287 of the upper bearing mount 245 engage the actuator plate 242 on a third axis Z. The first axis X is axially above the second axis Y and the third axis Z. The second axis Y is axially below the first axis X and the third axis Z. The third axis Z is axially between the first axis X and the second axis Y as shown in FIG. 18.

The first ball 295 of the lower bearing mount 247 is arranged on an axis that complements the second axis Y. The second ball 296 and third ball 297 of lower bearing mount 247 are arranged on an axis that complements the third axis Z. The fourth ball 298 is arranged on an axis that complements the first axis X. The axis provided by balls 295, 296, 297, 298 position the actuator plate at an angle relative to the horizontal axis B.

The bearing driver 243 is configured to angle the actuator plate 242 at an angle of about six degrees from the horizontal axis B as shown in FIG. 16. However, any suitable angle may be used. The first ball 285 of the upper bearing mount 245 and the fourth ball 298 of the lower bearing mount 247 are configured to angle a first half, or portion, of the actuator plate 242 upward relative to the central axis A at an angle of about six degrees from the horizontal axis B. The first ball 295 of the lower bearing mount 247 and the fourth ball 288 of the upper bearing mount 245 are configured to angle a second half, or portion, of actuator plate 242 downward relative to the central axis A at an angle of about six degrees from horizontal axis B.

The plurality of diaphragms 252 includes a first diaphragm 260, a second diaphragm 261, a third diaphragm 262, a fourth diaphragm 263, a fifth diaphragm 264, a sixth diaphragm 265, a seventh diaphragm 266, and an eighth diaphragm 267 as shown in FIG. 15. Each diaphragm 260, 261, 262, 263, 264, 265, 266, 267 is equally spaced circumferentially around the actuator plate 242 and the diaphragm ring 250. The balls 285, 286, 287, 288 and the balls 295, 296, 297, 298 engage actuator plate 242 to move actuator plate 242 and each diaphragm 260, 261, 262, 263, 264, 265, 266, 267 from the expanded configuration to the compressed configuration in series as bearing driver 243 rotates about the central axis A.

The first ball 295 of the lower bearing mount 247 is axially aligned with the fourth ball 288 of the upper bearing mount 245. The expanded configuration occurs when the first ball 295 of the lower bearing mount 247 and the fourth ball 288 of the upper bearing mount 245 are aligned circumferentially with one of the diaphragms 260, 261, 262, 263, 264, 265, 266, 267. The compressed configuration occurs when the first ball 285 of the upper bearing mount 245 and the fourth ball 298 of the lower bearing mount 247 are aligned circumferentially with one of the diaphragms 260, 261, 262, 263, 264, 265, 266, 267. In one example, each diaphragm moves from the compressed configuration to the expanded configuration during one rotation of motor 38 as shown in FIGS. 17-20.

In one example, the bearing driver 243 begins at 0 degrees of rotation as shown in FIG. 17. The first ball 285 of the upper bearing mount 245 and the fourth ball 298 of the lower bearing mount 247 are aligned circumferentially with the sixth diaphragm 265. The actuator plate 242 moves the sixth diaphragm 265 to the compressed configuration. The fourth and fifth diaphragms 263, 264 are moving toward the compressed configuration as the bearing driver 243 rotates clockwise about the central axis A. The seventh and eighth diaphragms 266, 267 are moving toward the expanded configuration as the bearing driver 243 rotates clockwise about central axis A.

In the example described above, the motor rotates 90 degrees clockwise about the central axis A as shown in FIG. 18 so that the bearing driver 243 is rotated 90 degrees from the orientation shown in FIG. 17. The first ball 285 of the upper bearing mount 245 and the fourth ball 298 of the lower bearing mount 247 are aligned circumferentially with the fourth diaphragm 263. The first ball 295 of the lower bearing mount 247 and the fourth ball 288 of the upper bearing mount 245 are aligned circumferentially with the eighth diaphragm 267. The actuator plate 242 moves the fourth diaphragm 263 to the compressed configuration and the eighth diaphragm 267 to the expanded configuration. The fifth, sixth, and seventh diaphragms 264, 265, 266 are moving toward the expanded configuration as the bearing driver 243 rotates clockwise about central axis A.

Figure 19:
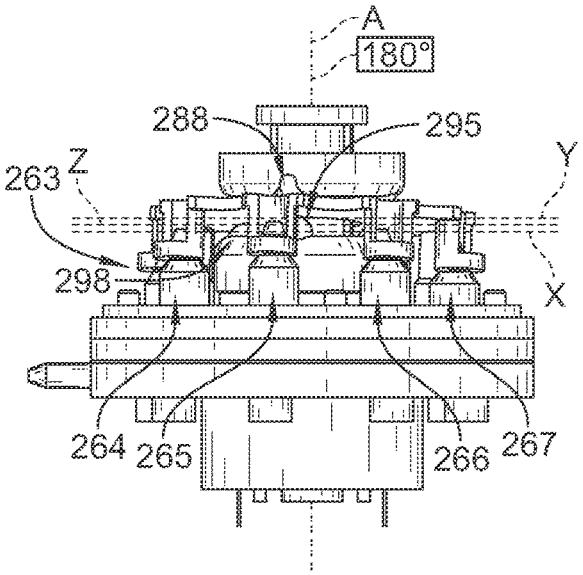

As shown in FIG. 19, the bearing driver 243 rotates another 90 degrees clockwise along the central axis A so that the bearing driver 243 is rotated 180 degrees from the orientation shown in FIG. 17. The first ball 295 of the lower bearing mount 247 and the fourth ball 288 of the upper bearing mount 245 are aligned circumferentially with the sixth diaphragm 265. The actuator plate 242 moves the sixth diaphragm 265 to the expanded configuration. The fourth and fifth diaphragms 263, 264 are moving toward the expanded configuration as the bearing driver 243 rotates clockwise about the central axis A. The seventh and eighth diaphragms 266, 267 are moving toward the compressed configuration as the bearing driver 243 rotates clockwise about the central axis A.

Figure 20:
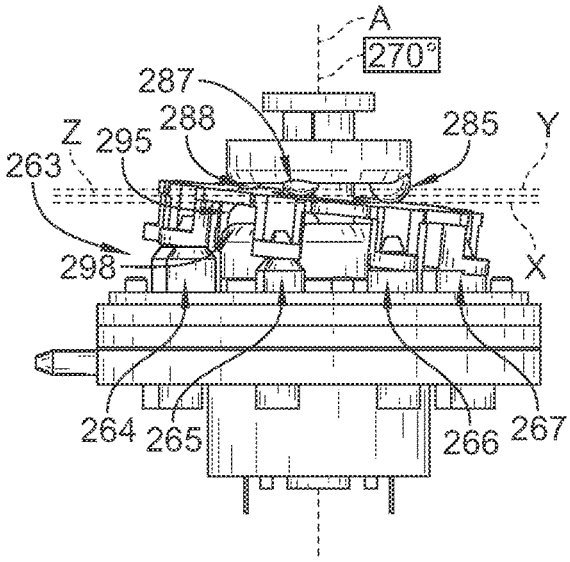

As shown in FIG. 20, the motor rotates another 90 degrees clockwise along the central axis A so that the bearing driver 243 is rotated 270 degrees from the orientation shown in FIG. 17. The first ball 285 of the upper bearing mount 245 and the fourth ball 298 of the lower bearing mount 247 are aligned circumferentially with the eighth diaphragm 267. The first ball 295 of the lower bearing mount 247 and the fourth ball 288 of the upper bearing mount 245 are aligned circumferentially with the fourth diaphragm 263. The actuator plate 242 moves the fourth diaphragm 263 to the expanded configuration and the eighth diaphragm 267 to the compressed configuration. The fifth, sixth, and seventh diaphragms 264, 265, 266 are moving toward the compressed configuration as the bearing driver 243 rotates clockwise about central axis A.

The bearing driver 243 is configured to continue rotating another 90 degrees clockwise along the central axis A so that the bearing driver 243 completes one full rotation of 360 degrees. At a rotation of 360 degrees, the bearing driver 243 positions the actuator plate 242 at the same orientation described above regarding FIG. 17.

Figure 21:
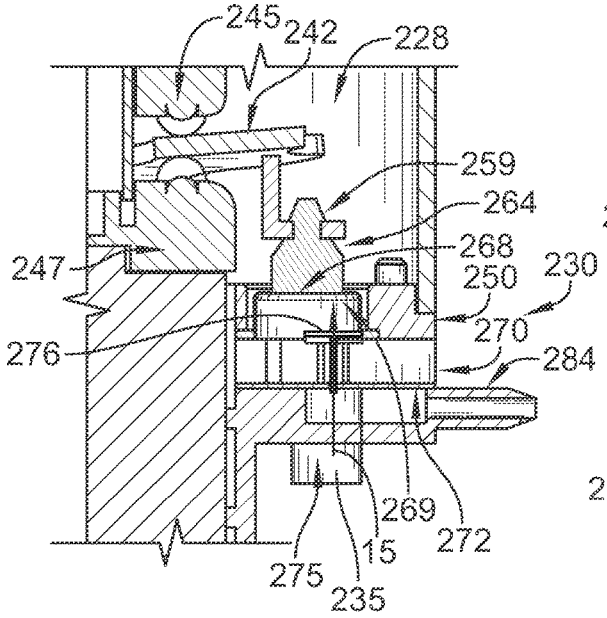
FIG. 21 is an enlarged portion of FIG. 14 showing that an airflow opens one of the inlet valves and flows through the inlet ring and into the diaphragm as the diaphragm expands.
Figure 22:
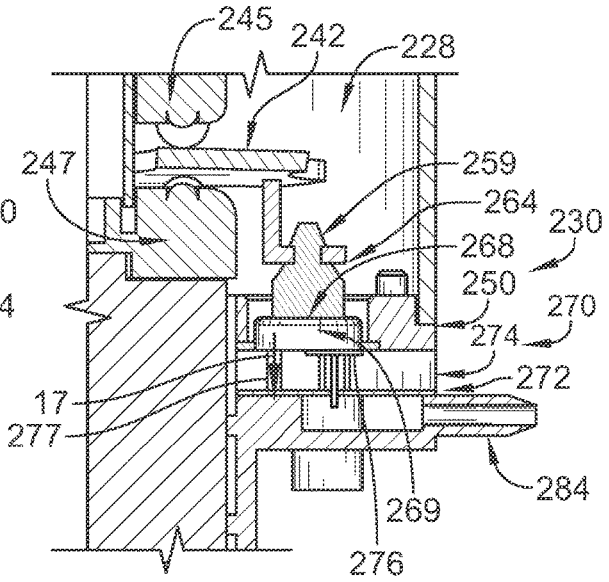
FIG. 22 is a view similar to FIG. 14 showing that a pressurized airflow closes the inlet valve and flows out of the diaphragm through the outlet ring as the diaphragm compresses.

Each diaphragm 260, 261, 262, 263, 264, 265, 266, 267 includes a diaphragm mount 259 and diaphragm housing 268 as shown in FIGS. 21 and 22. Each diaphragm mount 259 is coupled to the actuator plate 242. Each diaphragm housing 268 is coupled to a complementary diaphragm mount 259 and is arranged to extend through the diaphragm tubes 251 formed in the diaphragm ring 250. Each diaphragm housing 268 is formed to include a compression chamber 269 that opens toward the fluid regulator 230.

As shown in FIG. 21, the fifth diaphragm 264 is positioned in the expanded configuration by the actuator plate 242. The compression chamber 269 has a maximum volume in the expanded configuration. As compression chamber 269 is expanded by actuator plate 242, airflow 15 is suctioned from outside pneumatic pump 218, through an inlet aperture 235, and into the compression chamber 269.

As shown in FIG. 22, the fifth diaphragm 264 is positioned in the compressed configuration by the actuator plate 242. The compression chamber 269 has a minimum volume in the compressed configuration. As compression chamber 269 is compressed by actuator plate 242, the airflow 17 is pressurized and forced out of the compression chamber 269 through an outlet aperture 237.

The fluid regulator 230 includes a fluid inlet controller 270 and a fluid outlet controller 272 as shown in FIGS. 21 and 22. The fluid inlet controller 270 and the fluid outlet controller respond to the expansion and contraction of the plurality of diaphragms 252 to control airflow into and out of the compression chambers 269.

The fluid inlet controller 270 includes an inlet ring 274 and inlet valves 276 as shown in FIGS. 15 and 21. The inlet ring 274 is formed to include inlet passageways 275 extending from the inlet apertures 235 to the compression chambers 269. The inlet valves 276 extend through the inlet passageways 275. One inlet valve 276 is configured to open as the fifth diaphragm 264 expands into the expanded configuration as shown in FIG. 21. The inlet valve 276 is configured to close and restrict flow through the inlet passageway 275 as the fifth diaphragm 264 is compressed into the compressed configuration as shown in FIG. 22.

Figure 23:
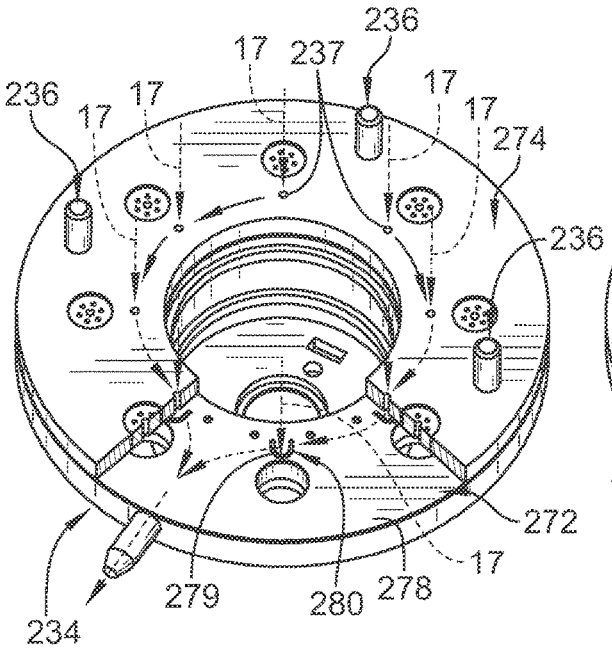
FIG. 23 is a partial perspective view of the pneumatic pump of FIG. 13 with portions of the pneumatic pump hidden to show that the pneumatic pump is configured to inject multiple pressurized airflows through a plurality of outlet passageways.

The fluid outlet controller 272 includes an outlet valve gasket 278 as shown in FIGS. 15 and 23. The outlet valve gasket 278 is arranged to control flow into and out of outlet passageways 277 formed in the inlet ring 274. The outlet valve gasket 278 is formed to include a plurality of U-shaped apertures 279 spaced apart circumferentially. The U-shaped apertures 279 define outlet flaps 280 that are arranged to cover the outlet passageways 277. One outlet flap 280 is configured close and restrict flow through the outlet passageway 277 as the fifth diaphragm 264 is expanded into the expanded configuration as shown in FIG. 21. The outlet flap 280 is configured to open and allow flow though the outlet passageway 277 as the fifth diaphragm 264 is compressed into the compressed configuration as shown in FIG. 22.

The pump housing 226 includes a top casing 232 and the bottom casing 234 as shown in FIGS. 14 and 15. The top casing 232 is positioned above the fluid-driving system 228 and forms an upper boundary for internal space 225. The bottom casing 234 is positioned below the fluid regulator 230 and is formed to include a plurality of inlet apertures 235 spaced apart circumferentially around the bottom casing 234.

Figure 24:
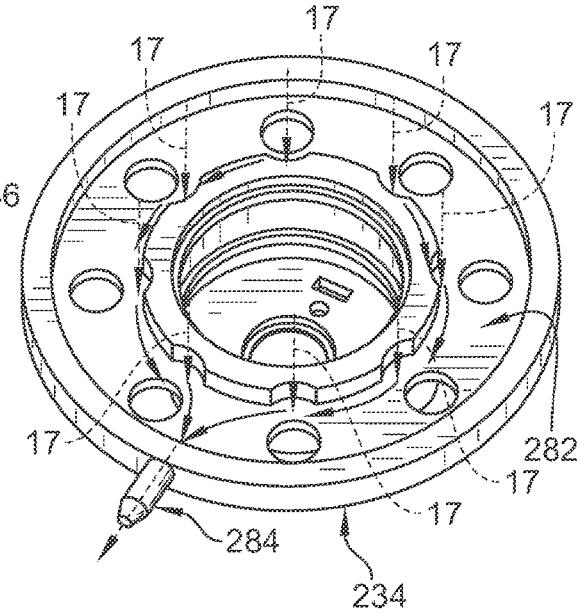
FIG. 24 is a partial perspective view of the pneumatic pump from FIG. 23 with the valve ring and the outlet ring hidden to show that each pressurized airflow flows through an outlet conduit formed in the bottom casing and out of the pneumatic pump through an outlet extending from the bottom casing.

The bottom casing 234 is shaped to define an outlet conduit 282 as shown in FIG. 24. The pressurized airflows 17 are forced into the outlet conduit 282 through the plurality of outlet apertures 237 as each diaphragm is compressed in series by the actuator plate 242. The pressurized airflows 17 are injected out of pneumatic pump 218 and into the pneumatic air bladders 24 through an outlet tube 284 coupled to bottom casing 234 as shown in FIG. 24.

A plurality of posts 236 extend from the inlet ring 274 toward the top casing 232 as shown in FIG. 23. The plurality of posts 236 aligns the fluid-driving system 228 and the fluid regulator 230 within the internal space 225. Fasteners (not shown) may extend through the top casing 232 and into the posts 236 to house the fluid-driving system 228 and the fluid regulator 230 in the internal space 225.

Figure 26:
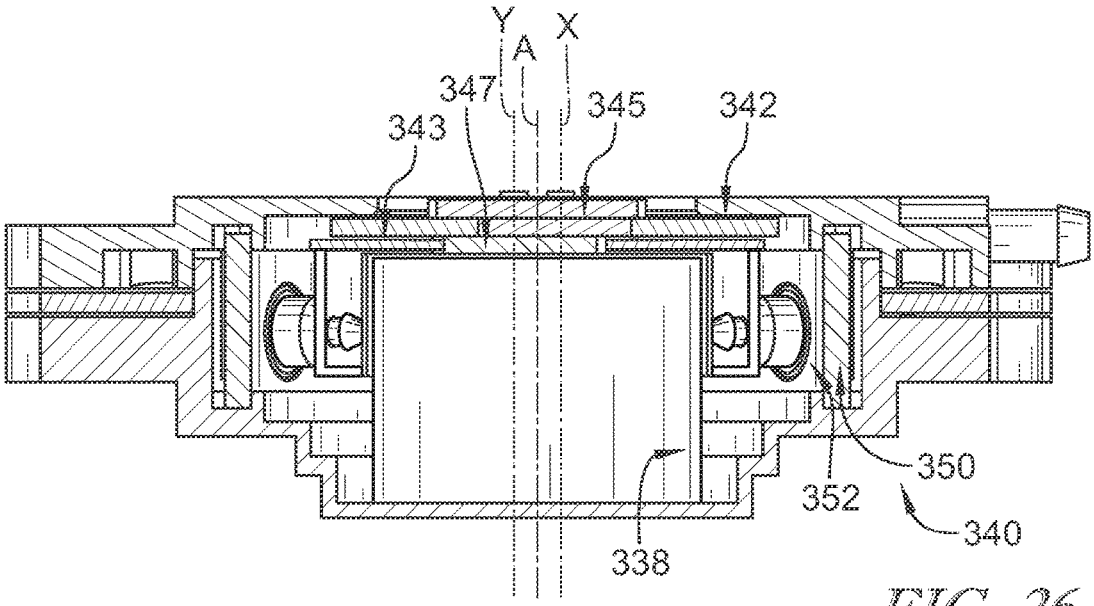
FIG. 26 is a sectional view taken along line 26-26 of FIG. 25 showing the third embodiment includes a motor, a pair of actuator plates, and a plurality of diaphragms coupled to the actuator plates and configured to compress and expand as the motor rotates about a central axis and moves the actuator plates.

A third embodiment of a pneumatic pump 318 in accordance with the present disclosure is shown in FIGS. 25-34. The pneumatic pump 318 includes a pump housing 326, a fluid-driving system 328, and a fluid regulator 330 as shown in FIGS. 25 and 26. Pump housing 326 is formed to include an internal space 325 therein. The fluid regulator 330 and the fluid-driving system 328 are located in the pump housing 326 as shown in FIG. 26. The fluid-driving system 328 moves within the pump housing 326 to draw an airflow from the environment and inject a pressurized airflow into the at least one pneumatic bladder 24. The fluid regulator 330 is configured to open and receive airflow from an environment outside of the pump housing 26 and then communicate pressurized airflow into the at least one pneumatic bladder 24.

Figure 27:
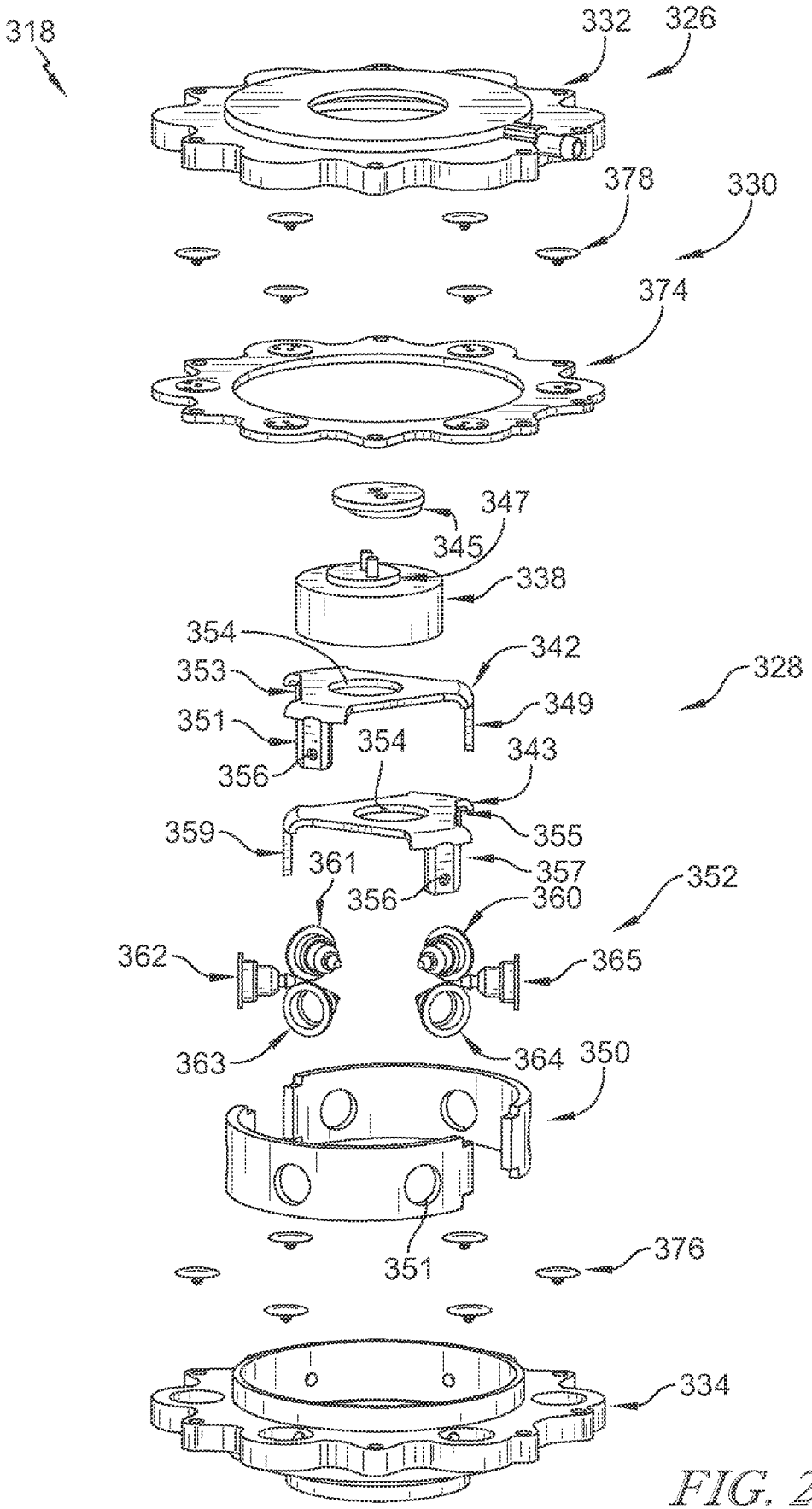
FIG. 27 is an exploded assembly view of the pneumatic pump of FIGS. 25 and 26 showing that the pneumatic pump includes, from top to bottom, a top casing, a plurality of outlet valves, an outlet ring, a first mount disk, a second mount disk, a motor, a first actuator plate, a second actuator plate, a plurality of diaphragms, a diaphragm ring, a plurality of inlet valves, and a bottom casing.

The fluid-driving system 328 includes a motor 338, a diaphragm system 340, and a first actuator plate 342 and a second actuator plate 343 as shown in FIGS. 26 and 27. The motor 338 is configured to rotate about a central axis A. The diaphragm system 340 is spaced apart radially and arranged to surround the motor 338 in the internal space 325 and is coupled to the actuator plates 342, 343. The actuator plates 342, 343 are driven by the motor 338 to cause the diaphragm system 340 to draw in air and pressurize the air.

The diaphragm system 340 includes a diaphragm ring 350 and a plurality of diaphragms 352 as shown in FIG. 27. The diaphragm ring 350 is arranged to extend around and surround the motor 338. The diaphragm ring 350 is configured to support and position the plurality of diaphragms 352 so that the plurality of diaphragms 352 remains in fluid communication with the fluid regulator 330. The plurality of diaphragms 352 is coupled to the actuator plates 342, 343. The plurality of diaphragms 352 is arranged to extend downwardly toward the fluid regulator 330.

Each diaphragm of the plurality of diaphragms 352 is configured to move between an expanded configuration in which air is drawn into the diaphragm through the fluid regulator 330 and a compressed configuration in which pressurized air is expelled from the diaphragm through the fluid regulator 330. Each diaphragm 352 expands and contracts in series as the motor 338 rotates driving the fluid-driving system 328. In one example, each diaphragm expands into the expanded configuration and contracts into the contracted configuration once during one rotation of the motor 338.

The fluid-driving system 328 is configured to provide a reciprocating in-and-out motion that moves the diaphragm system 340 and the actuator plates 342, 343. The fluid-driving system 328 further includes a first mount disk 345 and a second mount disk 347 that rotate about the central axis A. As the motor 338 rotates, the first mount disk 345 engages the first actuator plate 342 and the second mount disk 347 engages the second actuator plate to cause the actuator plates 342, 343 to move to cause each diaphragm in the plurality of diaphragms 352 to expand and contract in series as shown in FIGS. 28-31.

The first actuator plate 342 includes a first tab 349, a second tab 351, and a third tab 353 as shown in FIG. 27. The tabs 349, 351, 353 are equally spaced circumferentially around the first actuator plate 342 and extend downward from the first actuator plate 342.

The second actuator plate 343 includes a first tab 355, a second tab 357, and a third tab 359 as shown in FIG. 27. Tabs 355, 357, 359 are equally spaced circumferentially around actuator plate 343 and extend downward from actuator plate 343.

Each tab 349, 351, 353, 355, 357, 359 is formed to include a diaphragm mount 356 configured to couple the plurality of diaphragms 352 to the actuator plates 342, 343. The actuator plates 342, 343 are also formed to include mount disk apertures 354. The mount disk apertures 354 are configured to receive the first mount disk 345 and the second mount disk 347 so that the first actuator plate 342 and the second actuator plate 343 engage to the motor 338.

The first mount disk 345 and the second mount disk 347 are configured to rotate about the central axis A along a first axis X and a second axis Y, respectfully. The first axis X is spaced apart from the central axis A on one side of the central axis A. The second axis Y is spaced apart an equal distance from the central axis A on the opposite side of the central axis A from the first axis X In this way, the first actuator plate 342 and the second actuator plate 343 move at the same time with equal and opposite motions.

The plurality of diaphragms 352 includes a first diaphragm 360, a second diaphragm 361, a third diaphragm 362, a fourth diaphragm 363, a fifth diaphragm 364, and a sixth diaphragm 365 as shown in FIG. 27. Each diaphragm 360, 361, 362, 363, 364, 365 is equally spaced circumferentially around the actuator plates 342, 343. The actuator plates 342, 342 move each diaphragm 360, 361, 362, 363, 364, 365 from the expanded configuration to the compressed configuration.

Figure 28:
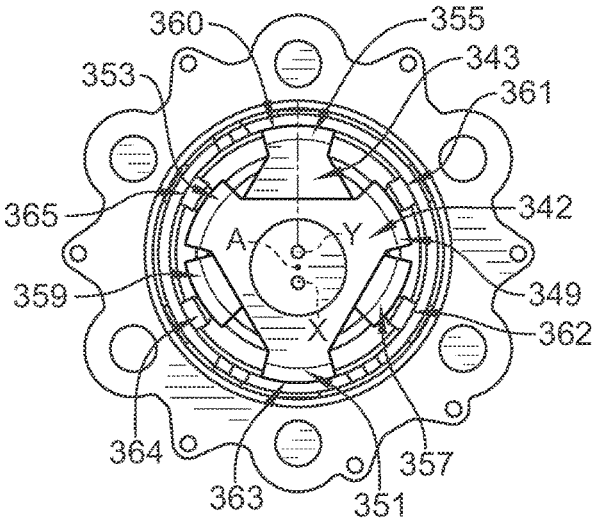
FIGS. 28-31 are a series of views showing the motor rotating 180 degrees about a central axis and moving the first and second actuator plates within the pump housing to compress and expand the plurality of diaphragms.
Figure 29:
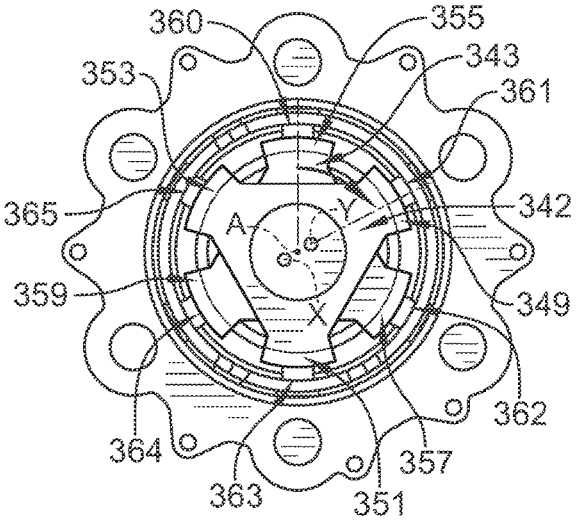
Figure 30:
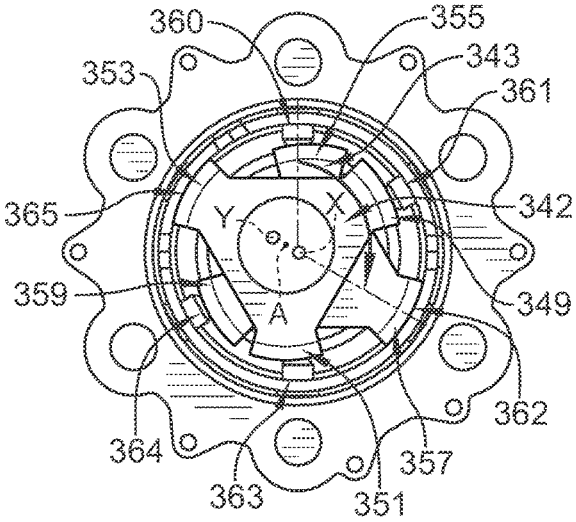
Figure 31:
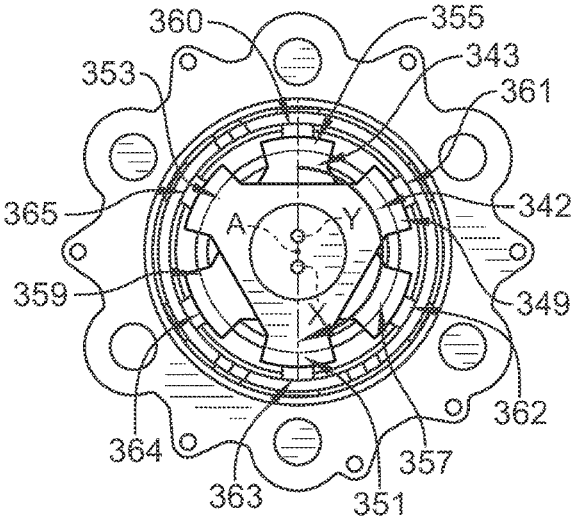

The compressed configuration occurs when the first axis X is aligned circumferentially with one of the tabs 349, 351, 353 of the first actuator plate 342, and when the second axis Y is aligned circumferentially with one of the tabs 355, 357, 359 of the second actuator plate 343 as shown in FIGS. 28 and 30. The expanded configuration occurs when the first axis X is aligned circumferentially with one of the tabs 355, 357, 359 of the second actuator plate 343, and when the second axis Y is aligned circumferentially with one of the tabs 349, 351, 353 of the first actuator plate 342 as shown in FIGS. 29 and 31. In one example, each diaphragm expands and compresses once during one rotation of the motor 338 as suggested in FIGS. 28-31.

In one example, the motor begins at 0 degrees of rotation as shown in FIG. 28. The first axis X of the first actuator plate 342 is aligned circumferentially with the second tab 351 of the first actuator plate 342. The second axis Y is aligned circumferentially with the first tab 355 of the second actuator plate 343. The first actuator plate 342 and the second actuator plate 343 are arranged so that both the first and fourth diaphragms 360, 363 are fully compressed in the compressed configuration.

In the example described above, the motor rotates 60 degrees clockwise about the central axis A as shown in FIG. 29 so that the motor 38 is rotated 60 degrees from the orientation shown in FIG. 28. The first axis X of the first actuator plate 342 is aligned circumferentially with the third tab 359 of the second actuator plate 343. The second axis Y is aligned circumferentially with the first tab 349 of the first actuator plate 342. The first actuator plate 342 and the second actuator plate 343 are arranged so that both the second and fifth diaphragms 361, 364 are fully expanded in the expanded configuration.

As shown in FIG. 30, the motor rotates another 60 degrees clockwise along the central axis A so that the motor 338 is rotated 120 degrees from the orientation shown in FIG. 28. The first axis X of the first actuator plate 342 is aligned circumferentially with the third tab 353 of the first actuator plate 342. The second axis Y is aligned circumferentially with the second tab 357 of the second actuator plate 343. The first actuator plate 342 and the second actuator plate 343 are arranged so that both the third and sixth diaphragms 362, 365 are fully compressed in the compressed configuration.

As shown in FIG. 31, the motor rotates another 60 degrees clockwise along the central axis A so that the motor 38 is rotated 180 degrees from the orientation shown in FIG. 28. The first axis X of the first actuator plate 342 is aligned circumferentially with the first tab 355 of the second actuator plate 343. The second axis Y is aligned circumferentially with the third tab 351 of the first actuator plate 342. The first actuator plate 342 and the second actuator plate 343 are arranged so that both the first and fourth diaphragms 360, 363 are fully expanded in the expanded configuration.

The motor 338 is configured to continue rotating another 180 degrees clockwise along the central axis A so that motor 338 completes one full rotation of 360 degrees. At a rotation of 360 degrees, the motor 38 positions the actuator plates 342, 343 at the same orientation described above regarding FIG. 28. Each of the diaphragms will have compressed and expanded once after 360 degrees of rotation, following the sequence described in the example above.

Each diaphragm 360, 361, 362, 363, 364, 365 includes a diaphragm mount 366 and diaphragm housing 368 as shown in FIGS. 32 and 33. Each diaphragm mount 366 on the second, fourth, and sixth diaphragms 361, 363, 365 is coupled to the first actuator plate 342. Each diaphragm mount 366 on the first, third, and fifth diaphragms 360, 362, 364 is coupled to the second actuator plate 343. Each diaphragm housing 368 is coupled to a complementary diaphragm mount 366 and is arranged to extend outward through the diaphragm tubes 341 formed in the diaphragm ring 350. Each diaphragm housing 368 is formed to include a compression chamber 369 that opens toward the fluid regulator 330.

As shown in FIG. 32, the fifth diaphragm 364 is positioned in the expanded configuration by the second actuator plate 343. The compression chamber 369 has a maximum volume in the expanded configuration. As the compression chamber 369 is expanded by the second actuator plate 343, the airflow 15 is suctioned from outside pneumatic pump 318, through an inlet aperture 335, and into the compression chamber 369.

As shown in FIG. 33, the fifth diaphragm 364 is positioned in the compressed configuration by the second actuator plate 343. The compression chamber 369 has a minimum volume in the compressed configuration. As the compression chamber 369 is compressed by the second actuator plate 343, the airflow 17 is pressurized and forced out of the compression chamber 369 through an outlet aperture 337.

The fluid regulator 330 includes a fluid inlet controller 370 and a fluid outlet controller 372 as shown in FIGS. 32 and 33. The fluid inlet controller 370 and the fluid outlet controller 372 respond to the expansion and contraction of the plurality of diaphragms 352 to control airflow into and out of the compression chambers 369.

The fluid inlet controller 370 includes inlet valves 376 as shown in FIGS. 27 and 32. The inlet valves 376 extend through inlet passageways 375. One inlet valve 376 is configured to open as the fifth diaphragm 364 expands into the expanded configuration as shown in FIG. 32. The inlet valve 376 is configured to close and restrict flow through the inlet passageway 375 as the fifth diaphragm 364 is compressed into the compressed configuration as shown in FIG. 33.

The fluid outlet controller 372 includes an outlet ring 374 an outlet valves 378 as shown in FIGS. 27 and 32. The outlet valves 378 are arranged to control flow into and out of the outlet passageways 377 formed in the outlet ring 374. One outlet valve 378 is configured close and restrict flow through the outlet passageway 377 as the fifth diaphragm 364 is expanded into the expanded configuration as shown in FIG. 9. The outlet valve 378 is configured to open and allow flow though the outlet passageway 377 as the fifth diaphragm 364 is compressed into the compressed configuration as shown in FIG. 33.

The pump housing 326 includes a top casing 332 and the bottom casing 334 as shown in FIGS. 26 and 27. The top casing 332 is positioned above the fluid-driving system 328 and forms an upper boundary for the internal space 325. The bottom casing 334 is positioned below the fluid regulator 330 and is formed to include a plurality of inlet apertures 335 spaced apart circumferentially around the bottom casing 334.

The top casing 332 is shaped to define an outlet conduit 382 as shown in FIG. 34. The pressurized airflows 17 are forced into outlet conduit 382 through the plurality of outlet apertures 337 as each diaphragm 352 is compressed into the compressed configuration. The pressurized airflows 17 are injected out of pneumatic pump 318 and into the pneumatic air bladders 24 through an outlet tube 384 coupled to the top casing 332.

The occupant comfort system 16, as shown in FIG. 1, includes the pneumatic pump 18, a pump controller 20, a manifold 22, and at least one pneumatic bladder 24. The pneumatic pump 18 is configured to provide an airflow to inflate the at least one pneumatic bladder 24 as directed by the pump controller 20. The pump controller 20 is configured to control pneumatic pump 18 and manifold 22 to either inflate or deflate the at least one pneumatic bladder 24. The at least one pneumatic bladder 24 is contained within vehicle seat 10 and is configured to receive the airflow from pneumatic pump 18 to inflate and support the occupant in the preferred position. The at least one pneumatic bladder 24 may be used to provide additional support, provide a massaging effort, or act as actuator moving other components.

The invention claimed is:

1. A pneumatic pump for use in a vehicle, the pneumatic pump comprising a pump housing including a top casing that has a downward-facing surface, a bottom casing coupled to the top casing and having an upward-facing surface, and a side wall that extends from the top casing toward the bottom casing and has an inward-facing surface that extends circumferentially around a central axis, the pump housing to define formed to include an internal space defined at least in part by each of the downward-facing surface, the upward-facing surface, and the inward-facing surface, a fluid-driving system located in the internal space and configured to provide pressurized fluid, and a fluid regulator located in the internal space and coupled to the fluid-driving system to receive and direct the pressurized fluid, wherein the fluid-driving system includes a hollow, cylindrical actuator having an angled top surface configured to rotate about the central axis, a diaphragm system including a plurality of diaphragms arranged on a horizontal reference plane that is perpendicular to the central axis and is arranged to extend through the hollow, cylindrical actuator and each of the plurality of diaphragms, each of the plurality of diaphragms spaced circumferentially apart from one another around the central axis and configured to engage the fluid regulator, and an actuator plate coupled to the motor to move in response to rotation of the actuator and coupled to the plurality of diaphragms to cause the plurality of diaphragms to move between a compressed state and an expanded state in response to rotation of the actuator.

2. The pneumatic pump of claim 1, wherein the fluid-driving system further comprises a motor coupled to the hollow, cylindrical actuator, the angled top surface having an upper portion and a lower portion opposite the upper portion relative to the central axis.

3. The pneumatic pump of claim 2, wherein the angled top surface of the actuator engages the actuator plate to cause a first portion of the actuator plate engaged by the upper portion to extend upwardly away from the bottom casing while a second portion of the actuator plate engaged by the lower portion extends downwardly away from the top casing.

4. The pneumatic pump of claim 3, wherein each of the plurality of diaphragms is moved to the compressed state in series by the actuator plate as the lower portion of the angled top surface faces each diaphragm.

5. The pneumatic pump of claim 2, wherein the angled top surface of the motor cooperates with a horizontal reference plane to define an included angle of 6 degrees.

6. The pneumatic pump of claim 1, wherein the actuator plate is made from a polymeric material.

7. The pneumatic pump of claim 6, wherein the polymeric material comprises an acetal resin.

8. The pneumatic pump of claim 1, wherein each of the plurality of diaphragms includes a diaphragm mount coupled to the actuator plate and a diaphragm housing coupled to the diaphragm mount and arranged to extend from the diaphragm mount to engage the fluid regulator and the diaphragm housing is formed to include a compression chamber therein.

9. The pneumatic pump of claim 8, wherein the diaphragm system further includes a stationary diaphragm ring spaced circumferentially around the actuator and formed to include a plurality of diaphragm tubes therein and the plurality of diaphragms are arranged to extend into the plurality of diaphragm tubes to be retained in fluid engagement with the fluid regulator.

10. The pneumatic pump of claim 1, wherein the each of the diaphragms are located circumferentially around the actuator.

11. The pneumatic pump of claim 1, wherein the fluid regulator includes a fluid inlet controller engaged with each of the diaphragms and a fluid outlet controller positioned axially between the bottom casing and the fluid inlet controller, and wherein the fluid inlet controller and the fluid outlet controller are each formed to include central apertures that receive the actuator.

12. The pneumatic pump of claim 1, wherein the internal space includes a first sub-region located between the top casing and an outer surface of each of the plurality of diaphragms and a second sub-region located between the bottom casing and an inner surface of each of the plurality of diaphragms, and the first sub-region is fluidly separated from the second sub-region.

13. The pneumatic pump of claim 1, wherein the upward-facing surface is spaced apart from the fluid regulator to define an outlet chamber therebetween and a plurality of inlet conduits extend through the outlet chamber between the upward-facing surface and the fluid regulator and each inlet conduit partially defines an inlet passageway that extends through the bottom casing to a compression chamber defined by each of the plurality of diaphragms.

14. The pneumatic pump of claim 1, wherein the angled top surface is in direct contact with a lower surface of the actuator plate, and the lower surface is arranged at a non-orthogonal angle relative to the central axis.

15. The pneumatic pump of claim 14, wherein the actuator is located entirely between the downward-facing surface of the top casing and the upward-facing surface of the bottom casing.

16. A pneumatic pump for use in a vehicle, the pneumatic pump comprising a pump housing including a top casing that has a downward-facing surface, a bottom casing coupled to the top casing and having an upward-facing surface, and a side wall that extends from the top casing toward the bottom casing and has an inward-facing surface that extends circumferentially around a central axis, the pump housing to define formed to include an internal space defined at least in part by each of the downward-facing surface, the upward-facing surface, and the inward-facing surface, and a fluid-driving system located in the internal space and configured to provide pressurized fluid, wherein the fluid-driving system includes a hollow, cylindrical actuator having an angled top surface configured to rotate about the central axis, a diaphragm system including a plurality of diaphragms spaced circumferentially apart from one another around the central axis and arranged on a horizontal reference plane that is perpendicular to the central axis and is arranged to extend through the hollow, cylindrical actuator relative to the central axis, and an actuator plate coupled to the actuator to move in response to rotation of the actuator and coupled to the plurality of diaphragms to cause the plurality of diaphragms to move between a compressed state and an expanded state in response to rotation of the actuator.

17. The pneumatic pump of claim 16, wherein the diaphragm system further includes a diaphragm ring that is formed to include a plurality of diaphragm tubes that each receive one of the diaphragms to support each diaphragm within the pump housing and a central aperture that receives the actuator to locate the plurality of diaphragms circumferentially around the actuator relative to the central axis.

18. The pneumatic pump of claim 16, further comprising a fluid regulator located in the internal space and coupled to the fluid-driving system to receive and direct the pressurized fluid, the fluid regulator including a fluid inlet controller with an inlet ring engaged with each of the diaphragms and a fluid outlet controller with an outlet valve gasket positioned axially between the bottom casing and the inlet ring and the inlet ring and the outlet valve gasket are each formed to include central apertures that receive the actuator.

19. The pneumatic pump of claim 16, wherein the internal space includes a first sub-region located between the top casing and an outer surface of each of the plurality of diaphragms and a second sub-region located between the bottom casing and an inner surface of each of the plurality of diaphragms, and the first sub-region is fluidly separated from the second sub-region.

20. The pneumatic pump of claim 16, wherein the bottom casing at least partially defines an outlet chamber between the upward-facing surface and the plurality of diaphragms and a plurality of inlet conduits extend through the outlet chamber away from the upward-facing surface, and each inlet conduit partially defines an inlet passageway that extends through the bottom casing to a compression chamber defined by each of the plurality of diaphragms.

21. The pneumatic pump of claim 16, wherein the angled top surface is in direct contact with a lower surface of the actuator plate, and the lower surface is arranged at a non-orthogonal angle relative to the central axis.

22. The pneumatic pump of claim 21, wherein the actuator is located entirely between the downward-facing surface of the top casing and the upward-facing surface of the bottom casing.

* * * * *